US012371872B2

(12) United States Patent
Ono

(10) Patent No.: US 12,371,872 B2
(45) Date of Patent: Jul. 29, 2025

(54) SHOVEL

(71) Applicant: SUMITOMO HEAVY INDUSTRIES, LTD., Tokyo (JP)

(72) Inventor: Tetsuji Ono, Chiba (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 425 days.

(21) Appl. No.: 17/585,874

(22) Filed: Jan. 27, 2022

(65) Prior Publication Data

US 2022/0170233 A1 Jun. 2, 2022

Related U.S. Application Data

(63) Continuation of application No. PCT/JP2020/029123, filed on Jul. 29, 2020.

(30) Foreign Application Priority Data

Jul. 31, 2019 (JP) ..... 2019-141579

(51) Int. Cl.
*E02F 3/43* (2006.01)
*E02F 3/32* (2006.01)
(Continued)

(52) U.S. Cl.
CPC ..... *E02F 3/435* (2013.01); *E02F 3/32* (2013.01); *E02F 9/2228* (2013.01); *E02F 9/205* (2013.01);
(Continued)

(58) Field of Classification Search
None
See application file for complete search history.

(56) References Cited

U.S. PATENT DOCUMENTS 5,854,988 A 12/1998 Davidson et al.
2003/0001751 A1 1/2003 Ogura et al.
(Continued)

FOREIGN PATENT DOCUMENTS

JP H10-103925 4/1998
JP 2001-159156 6/2001
(Continued)

OTHER PUBLICATIONS

International Search Report for PCT/JP2020/029123 mailed on Oct. 20, 2020.

*Primary Examiner* — Anshul Sood
(74) *Attorney, Agent, or Firm* — IPUSA, PLLC

(57) ABSTRACT

The shovel includes an attachment including a boom; an arm; and a bucket, wherein the bucket includes a first part and a second part, shapes of the first and second parts being mutually different, and wherein the attachment performs, in response to an operation of the attachment, a first action or a second action, the first operation causing the attachment to activate such that the first part moves along a predetermined trajectory, and the second operation causing the attachment to activate such that the second part moves along another predetermined trajectory, and wherein the shovel is configured to switch, based on at least one from among a state of the shovel and a circumference state of the shovel, between a case where the first action is performed and a case where the second action is performed.

16 Claims, 11 Drawing Sheets

(51) Int. Cl.
*E02F 9/20* (2006.01)
*E02F 9/22* (2006.01)

(52) U.S. Cl.
CPC ..... *E02F 9/2285* (2013.01); *E02F 9/2292* (2013.01); *E02F 9/2296* (2013.01)

(56) References Cited

U.S. PATENT DOCUMENTS

| | | | | |
|---|---|---|---|---|
| 2014/0184122 | A1* | 7/2014 | Ogawa | E02F 9/2095 318/461 |
| 2016/0010312 | A1 | 1/2016 | Kurihara et al. | |
| 2017/0275852 | A1* | 9/2017 | Yamashita | F15B 11/08 |
| 2017/0284070 | A1 | 10/2017 | Matsuyama et al. | |
| 2018/0156244 | A1* | 6/2018 | Ma | F15B 13/021 |
| 2019/0127946 | A1 | 5/2019 | Sakai et al. | |
| 2020/0256034 | A1 | 8/2020 | Yamamoto | |
| 2020/0325650 | A1 | 10/2020 | Tsukamoto et al. | |
| 2021/0332566 | A1 | 10/2021 | Shintani et al. | |

FOREIGN PATENT DOCUMENTS

| | | |
|---|---|---|
| JP | 2008-106440 | 5/2008 |
| JP | 4455465 | 4/2010 |
| JP | 2014-101664 | 6/2014 |
| JP | 2017-008719 | 1/2017 |
| JP | 2018-003514 | 1/2018 |
| WO | 2002/040783 | 5/2002 |
| WO | 2016/129708 | 8/2016 |
| WO | 2019/049309 | 3/2019 |
| WO | 2019/093103 | 5/2019 |
| WO | 2019/131980 | 7/2019 |

* cited by examiner

SHOVEL

CROSS-REFERENCE TO RELATED APPLICATIONS

The present application is a continuation application of International Application No. PCT/JP2020/029123, filed Jul. 29, 2020, which claims priority to Japanese Patent Application No. 2019-141579, filed Jul. 31, 2019. The contents of these applications are incorporated herein by reference in their entirety.

BACKGROUND

Technical Field

This disclosure relates to a shovel.

Description of Related Art

A function of controlling an attachment as a whole (hereinafter, referred to as "machine control function") in a shovel such that a working part of a bucket performs a predetermined construction operation according to an operation of the attachment is known (see Patent Document 1).

For example, the machine control function automatically controls an excavation operation of the attachment such that a tip end (claw tip) of a bucket does not excavate below a target surface in response to an operation of the attachment.

However, when a process of excavating by a claw tip of a bucket is shifted to a compaction work using a back side of the bucket, a machine control function needs to be canceled and the compaction work using the back side of the bucket needs to be performed manually. Therefore, there is room for improvement from the viewpoint of the work efficiency of the shovel.

In order to achieve the above object, one embodiment of the present invention provides a shovel including attachments including a boom, an arm, and a bucket, wherein the bucket includes a first part and a second part, shapes of the first and second parts being mutually different, and wherein the attachment performs, in response to an operation of the attachment, a first action or a second action, the first operation causing the attachment to activate such that the first part moves along a predetermined trajectory, and the second operation causing the attachment to activate such that the second part moves along the predetermined trajectory, wherein the shovel is configured to switch, based on at least one from among a state of the shovel and a circumference state of the shovel, between a case where the first action is performed and a case where the second action is performed.

DETAILED DESCRIPTION

Hereinafter, an embodiment for carrying out the invention will be described with reference to the drawings.

[Outline of Shovel]

First, an outline of a shovel 100 according to a present embodiment will be described with reference to FIGS. 1 and 2.

Figure 1:
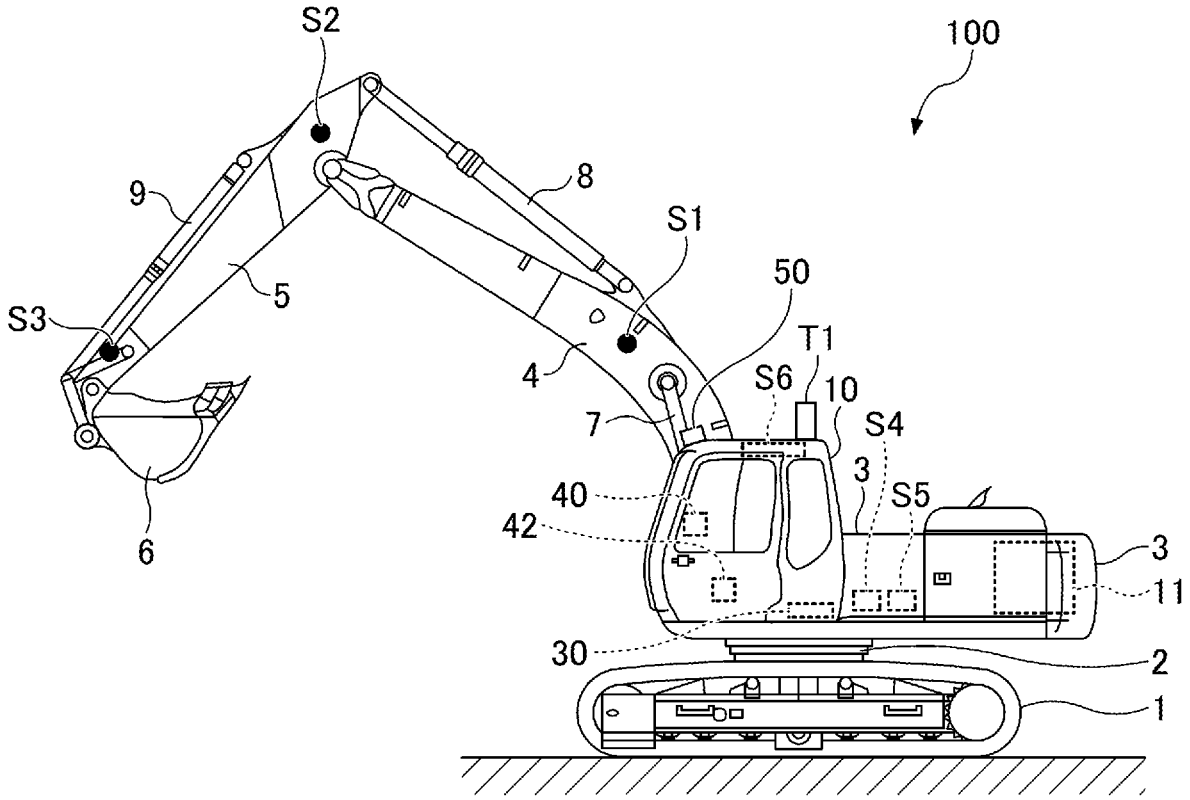
FIG. 1 is a side view of a shovel.

FIG. 1 is a side view of the shovel 100 in accordance with the present embodiment. FIG. 2 is a diagram illustrating an example of a shovel management system SYS including the shovel 100.

As illustrated in FIG. 1, the shovel 100 in accordance with the present embodiment includes a lower travel body 1, an upper swivel body 3 that is rotatably mounted to the lower travel body 1 through a swivel mechanism 2, an attachment (work machine) including a boom 4, an arm 5, and a bucket 6, and a cabin 10.

In the lower travel body 1, a pair of crawlers respectively provided on left and right sides is hydraulically driven by respective travel hydraulic motors 1L and 1R so as to drive the shovel 100. That is, a pair of the travel hydraulic motors 1L and 1R (an example of a traveling motor) drives the lower travel body 1 (crawler) as a driven element.

The upper swivel body 3 is driven by a swivel hydraulic motor 2A so as to rotate relative to the lower travel body 1. That is, the swivel hydraulic motor 2A drives the upper swivel body 3 as a driven element.

The boom 4 is swingably mounted to a front center of the upper swivel body 3 in a vertical direction, the arm 5 is swingably mounted to the tip end of the boom 4 in a vertical direction, and the bucket 6 as an end attachment is swingably mounted to a tip end of the arm 5 in a vertical direction. The boom 4, arm 5, and bucket 6 are hydraulically driven by a boom cylinder 7, arm cylinder 8, and bucket cylinder 9, which are hydraulic actuators, respectively.

The bucket 6 is an example of the end attachment. Another end attachment, such as a slope bucket, a dredging bucket, a breaker, or the like, may be attached to the tip end of the arm 5 instead of the bucket 6, depending on work content or the like.

The cabin 10 is a driver's room where an operator board. The cabin 10 is provided on the front left side of the upper swivel body 3.

Figure 2:
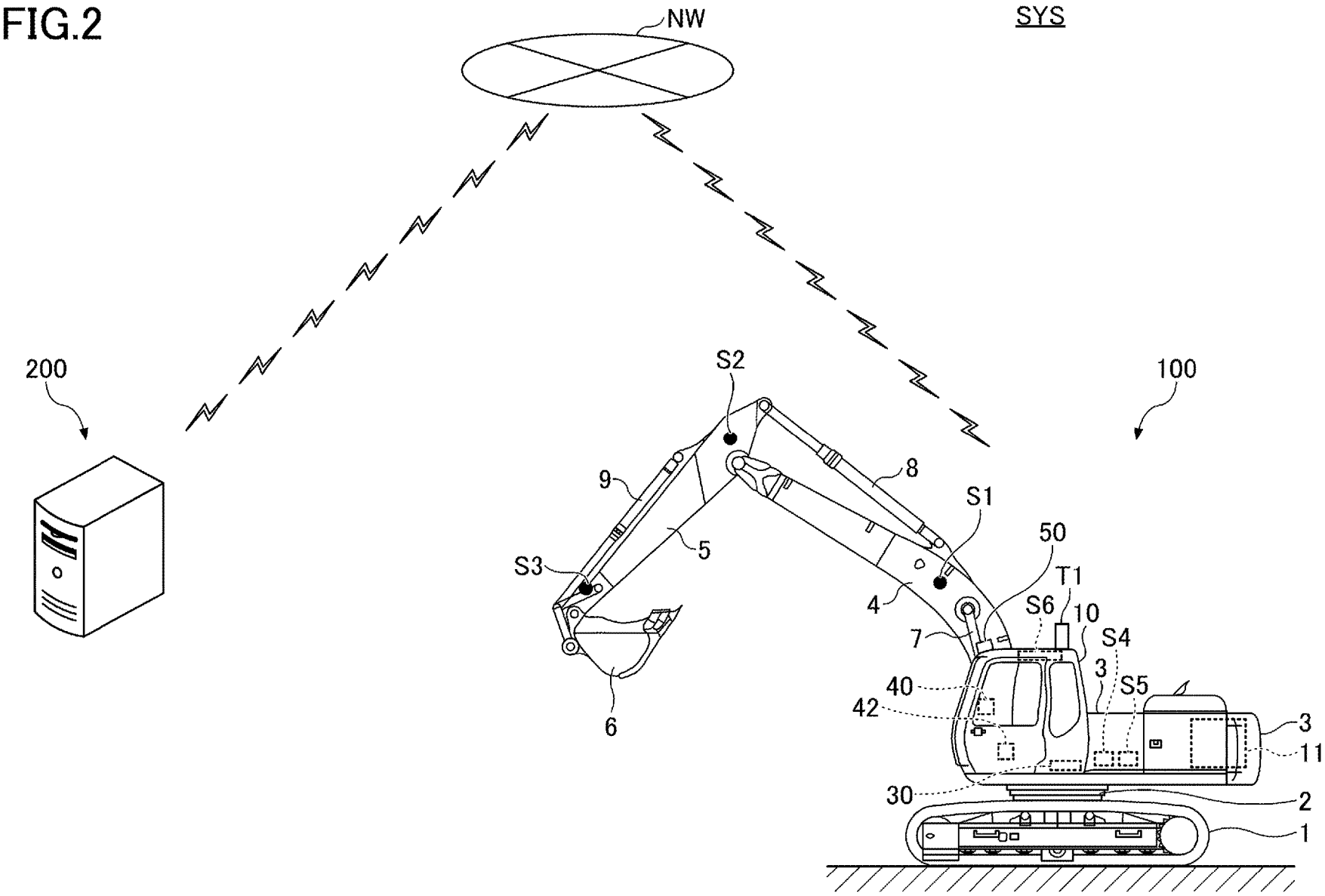
FIG. 2 is a diagram illustrating an example of a shovel management system.

As illustrated in FIG. 2, the shovel 100 may be a constitutional element of the shovel management system SYS.

The shovel management system SYS includes the shovel 100 and the management device 200.

The number of the shovels 100 included in the shovel management system SYS may be one or more. Similarly, a plurality of management devices 200 may be included in the shovel management system SYS. That is, the plurality of management devices 200 may perform processings relating to the shovel management system SYS such that the processings are distributed. For example, each of the plurality of management devices 200 may mutually communicate with some of shovels among the plurality of shovels 100, and perform processing targeting the unit of the shovel 100.

For example, in the management device 200, the shovel management system SYS collects information from the shovel 100 and monitors various conditions of the shovel 100 (for example, presence or absence of abnormalities in various devices mounted to the shovel 100).

The shovel management system SYS may also assist the remote operation of the shovel 100, for example, in the management device 200.

The shovel 100 mounts the communication device T1 and can mutually communicate with the management device 200 through a predetermined communication line network (NW). Accordingly, the shovel 100 can transmit (upload) various information to the management device 200 or receive various signals (for example, an information signal or control signal) from the management device 200. The communication line NW includes, for example, a wide area network (WAN). For example, the wide area network may include a mobile communication network whose terminal is a base station. The wide area network may also include, for example, a satellite communication network utilizing communication satellites above the shovel 100. The wide area network may also include, for example, the Internet. The communication line NW may also include, for example, a local network (LAN) of the facility in which the management device 200 is installed. The local network may be a wireless line, a wired line, or a line that includes both. The communication line NW may also include a short distance communication line based on a predetermined wireless communication system, for example, WiFi or Bluetooth ("Bluetooth" is a registered trademark).

The shovel 100 causes an actuator (e.g., a hydraulic actuator) to be activated in response to a user's operation of the operator in the cabin 10 so as to drive activated elements (hereinafter, referred to as "driven element") such as the lower travel body 1, the upper swivel body 3, the boom 4, the arm 5, and the bucket 6.

The shovel 100 may also be configured such that the operator in the cabin 10 can operate the shovel 100, or can be alternatively or additionally remotely operated from an outside of the shovel 100. If the shovel 100 is remotely operated, the interior of the cabin 10 may be unmanned. In the following, description is given on the premise that at least one from among the operation of the operation device 26 in the cabin 10 by the operator and the remote operation by an external operator is included in the operator's operation.

For example, the remote operation includes a mode of an operation of the shovel 100 in response to an input by the user (operator) to the predetermined external device (e.g., management device 200) for activating the actuator of the shovel 100. In this case, the shovel 100 may be installed with an imaging device 50 capable of imaging the circumference of the shovel 100 including a forward side of the shovel 100. For example, the shovel 100 transmits image information (hereinafter, referred to as "circumference image") of the circumference of the shovel 100 based on the output of the imaging device 50 to an external device, and the circumference image may be displayed on a display device (hereinafter, referred to as "display device for remote operation") provided on the external device. The various information images (information screens) displayed on the display device 40 in the cabin 10 of the shovel 100 may also be displayed on the display device for remote operation of the external device. With this, the operator of the external device can remotely control the shovel 100 while checking the display contents of the circumference image representing the circumference of the shovel 100 or various information images displayed on the display device for remote operation, for example. The shovel 100 may operate an actuator in response to a signal (hereinafter, referred to as "remote operation signal") received from an external device representing the contents of the remote operation, and driven elements such as the lower travel body 1, the upper swivel body 3, the boom 4, the arm 5, and the bucket 6.

Note that when the shovel 100 is not remotely controlled from the external device, the imaging device 50 of the shovel 100 need not be installed 608 or may be used for a different use (for example, monitoring obstacles surrounding the shovel.

A remote operation may also include a mode in which the shovel 100 is operated by sound input, gesture input, or the like to the shovel 100 from a person (e.g., a worker) around the shovel 100. Specifically, the shovel 100 recognizes, through the imaging device 50 or the sound input device (e.g., a microphone), a voice uttered by a neighboring operator or a gesture performed by a worker or the like. The shovel 100 may then operate an actuator in accordance with the contents of the recognized voice, gesture, or the like to drive driven elements such as the lower travel body 1, the upper swivel body 3, the boom 4, the arm 5, and the bucket 6.

The shovel 100 may also automatically operate the actuator regardless of the operator's operation. Accordingly, the shovel 100 provides a function (a machine control (MC control) function) to automatically operate at least a part of a driven element such as the lower travel body 1, the upper swivel body 3, the boom 4, the arm 5, and the bucket 6.

The MC function includes a function that drives the actuator to automatically perform predetermined operations (hereinafter, referred to as "operation-assisted MC function") in response to predetermined operation or remote operation of an operator's operation device 26. In the operation-assisted MC function, the shovel 100 may, for example, automatically operate the driven element (actuator) other than the driven element (actuator) to be operated. The MC function may include function to automatically activate at least a unit of a plurality of driven elements (hydraulic actuators) without any operation or remote operation on the operator's operation device 26 (hereinafter, referred to as "fully automatic MC function"). In the shovel 100, the interior of the cabin 10 may be unmanned if the fully automated MC function is enabled. Further, the operation-assisted MC function, the fully automatic MC function, or the like may include a mode in which the operation content of the driven element (actuator) subject to the MC function is automatically determined according to a predefined rule. Further, the operation-assisted type MC function, the fully automatic MC function, or the like may include a mode in which the shovel 100 autonomously makes various judgments and determines the operation contents of the driven element (actuator) subject to the MC function autonomously based on the judgment results (what is known as "autonomous operation").

The management device 200 may be, for example, a cloud server is located at a management center or the like external to the work site in which the shovel 100 conducts the work. The management device 200 may be, for example, an edge server disposed in the work site where the shovel 100 performs the work or a location relatively close to the work site (e.g., a station building of a telecommunications carrier, a base station, or the like). The management device 200 may be a stationary type terminal device or a portable type terminal device (a portable terminal) disposed at a management office or the like within the work site of the shovel 100. The stationary terminal may include, for example, a desktop computer terminal. The portable terminal device may also include, for example, a smartphone, a tablet terminal, a laptop computer terminal, or the like. The management device 200 may also be brought into the interior of the cabin 10 of the shovel 100 by a user, if it is the portable terminal device.

The management device 200 includes, for example, a communication device for communicating with the shovel 100 through a communication line NW as described above. Accordingly, the management device 200 may receive various information uploaded from the shovel 100 and transmit various signals to the shovel 100. Therefore, the user of the management device 200 can check various information regarding the shovel 100 through an output device (e.g., a display device, a sound output device, or the like). The management device 200 may, for example, transmit an information signal to the shovel 100 to provide the information necessary for the work, transmit a control signal, and control the shovel 100. Users of the management device 200 may include, for example, the owner of the shovel 100, the administrator of the shovel 100, the engineer of the manufacturer of the shovel 100, the operator of the shovel 100, the administrator of the work site of the shovel 100, the supervisor of the work site of the shovel 100, the operator of the work site of the shovel 100, and the like.

The management device 200 may also be configured to assist in the remote operation of the shovel 100. For example, the management device 200 may include the input device for the remote operation by the operator (hereinafter, for convenience, referred to as "remote operation device") and a remote operation display device for displaying image information (ambient image) around the shovel 100 and the like. The signal input from the remote operation device is transmitted to the shovel 100 as the remote operation signal. Accordingly, the user (operator) of the management device 200 can perform the remote operation of the shovel 100 using the remote operation device while checking the circumference of the shovel 100 with the remote operation display device.

[First Example of Shovel]

Next, a first example of the shovel 100 according to this embodiment will be described in detail with reference to FIGS. 3 to 5 (FIGS. 5A and 5B) in addition to FIGS. 1 and 2.

<Structure of Shovel>

Figure 3:
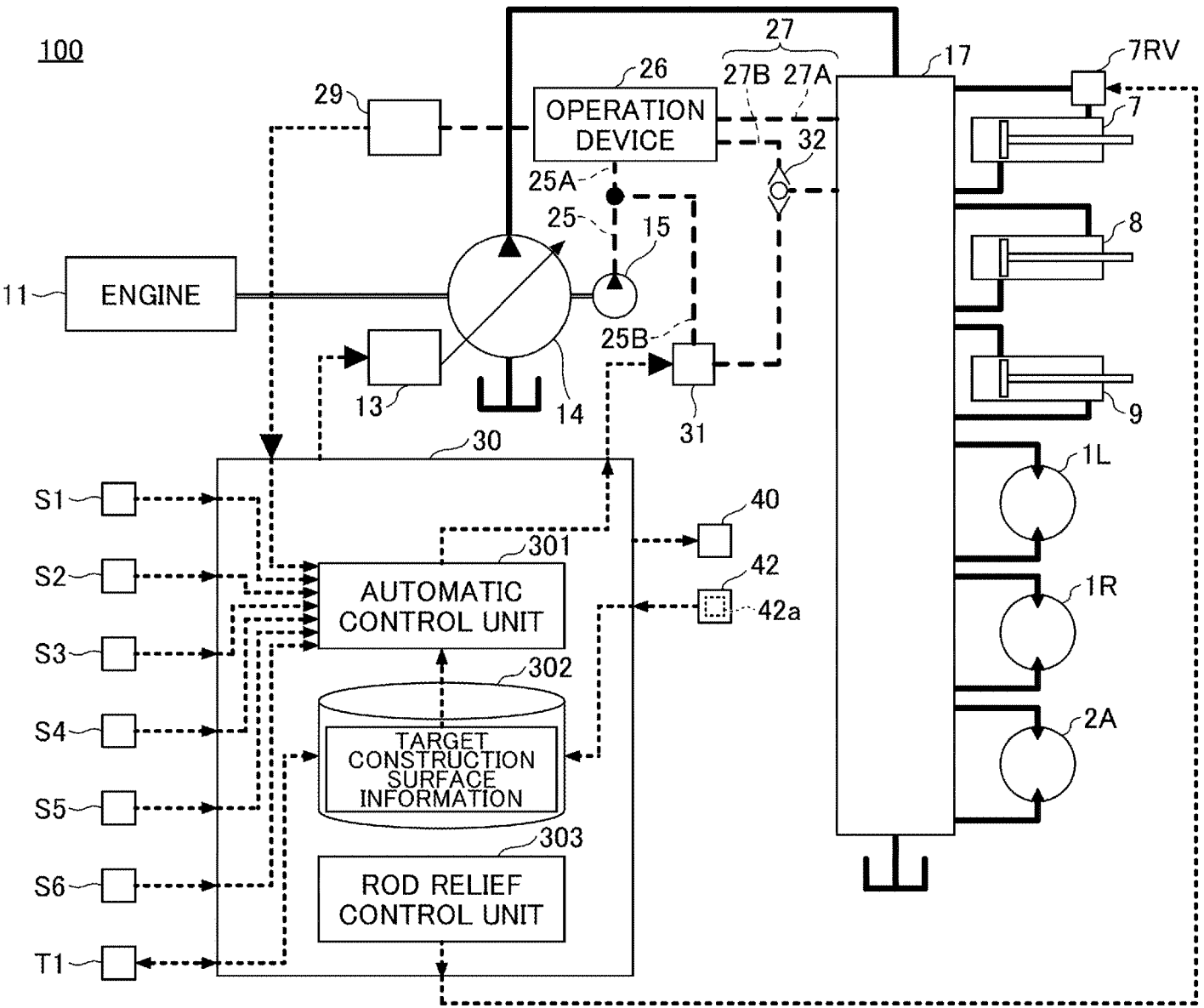
FIG. 3 is a block diagram schematically illustrating a first example of the structure of the shovel.

FIG. 3 is a block diagram schematically showing the first example of the structure of the shovel 100 according to the present embodiment.

In FIG. 3, mechanical power lines, hydraulic oil lines, pilot lines, and electrical signal lines are represented by double, solid, dashed, and dotted lines, respectively. Hereinafter, the same shall apply to FIG. 6, which will be described later.

<<Hydraulic Drive System>>

As illustrated in FIG. 3, the hydraulic drive system of the shovel 100 in accordance with the present embodiment includes a hydraulic actuator that hydraulically drives each of the lower travel body 1, the upper swivel body 3, the boom 4, the arm 5, and the bucket 6. As described above, the hydraulic actuator includes travel hydraulic motors 1L and 1R, a swivel hydraulic motor 2A, a boom cylinder 7, an arm cylinder 8, a bucket cylinder 9, and so on. The hydraulic drive system of the shovel 100 according to the present embodiment also includes an engine 11, a regulator 13, a main pump 14, a control valve 17, and a relief valve 7RV.

The engine 11 is a main power source in the hydraulic drive system and is mounted, for example, on the rear of the upper swivel body 3. Specifically, the engine 11 rotates at a predetermined target speed under direct or indirect control by the controller 30 to drive the main pump 14 and the pilot pump 15. The engine 11 is, for example, a diesel engine fueled with diesel oil.

The regulator 13 controls the discharge amount of the main pump 14. For example, the regulator 13 adjusts the angle (tilt angle) of the swash plate of the main pump 14 in response to control commands from the controller 30.

For example, the main pump 14 like the engine 11 is mounted on the rear of the upper swivel body 3 to supply hydraulic oil to the control valve 17 through a high pressure hydraulic line. The main pump 14 is driven by the engine 11 as described above. For example, the main pump 14 is a variable capacity hydraulic pump. As described above, under the control of the controller 30, the angle of tilt of the swash plate is adjusted by the regulator 13, such that the length of the piston stroke is adjusted and the discharge flow rate (discharge pressure) is controlled.

For example, the control valve 17 is mounted at the center of the upper swivel body 3 and controls the hydraulic drive system in response to an operator's operation of the operation device 26. As described above, the control valve 17 is connected to the main pump 14 via a high pressure hydraulic line and selectively supplies the hydraulic oil supplied from the main pump 14 to the hydraulic actuators (such as the travel hydraulic motors 1L and 1R, the swivel hydraulic motor 2A, the boom cylinder 7, the arm cylinder 8, and the bucket cylinder 9). For example, the control valve 17 includes the control valve (spool valve) for controlling the flow rate and flow direction of hydraulic oil supplied from the main pump 14 to each of the hydraulic actuators.

The relief valve 7RV is provided in the high-pressure hydraulic line between the rod-side oil chamber of the boom cylinder 7 and the control valve 17 in response to the control command from the controller 30 to discharge (relief) the hydraulic oil from the rod-side oil chamber of the boom cylinder 7 into a tank. Accordingly, the relief valve 7RV can discharge the hydraulic oil from the rod-side oil chamber of the boom cylinder 7 to the tank under the control of the controller 30 to suppress the excessive hydraulic pressure from increasing. Therefore, the controller 30 can limit the pressure of the rod-side oil chamber of the boom cylinder 7 to be not more than a predetermined threshold value by, for example, outputting the control command to the relief valve 7RV and setting a predetermined relief pressure.

<<Operation>>

As illustrated in FIG. 3, the operating system of the shovel 100 in accordance with the present embodiment includes a pilot pump 15 and an operation device 26. The operating system of the shovel 100 also includes an oil pressure control valve 31 and a shuttle valve 32 as structures for machine control functions by the controller 30.

The pilot pump 15, for example, is mounted to the rear of the upper swivel body 3 and supplies pilot pressure to various hydraulic devices such as the operation device 26 and the oil pressure control valve 31 via the pilot line 25. For example, the pilot pump 15 is a fixed capacitive hydraulic pump driven by an engine 11 as described above.

The operation device 26 is provided near the cockpit of the cabin 10 and is used by the operator to operate the respective driven elements (i.e., the lower travel body 1, the upper swivel body 3, the boom 4, the arm 5, the bucket 6, etc.). In other words, the operation device 26 is used by the operator to operate the hydraulic actuators (i.e., travel hydraulic motors 1L and 1R, the swivel hydraulic motor 2A, the boom cylinder 7, the arm cylinder 8, the bucket cylinder 9, etc.) that drive the respective driven elements. The operation device 26 includes a separate operation device for each driven element (hydraulic actuator) (hereinafter, for convenience, referred to as "individual operation device"). For example, the operation device 26 includes, the lever devices for operating the upper swivel body 3 (rotation hydraulic motor 2A), the boom 4 (boom cylinder 7), the arm 5 (arm cylinder 8), and the bucket 6 (bucket cylinder 9). The operation device 26 also includes, for example, a lever device or a pedal device for operating the right and left crawlers (travel hydraulic motors 1L and 1R) of the lower travel body 1.

The operation device 26 is a hydraulic pilot type, for example, as illustrated in FIG. 3. The operation device 26 uses the pilot pressure of the hydraulic oil supplied from the pilot pump 15 through the pilot line 25 and the pilot line 25A branching from the pilot line 25 to output a corresponding pilot pressure to the secondary pilot line 27 (pilot lines 27A, 27B). The individual operation devices included in the operation device 26 are each connected to the control valve 17 (corresponding control valves within the control valve 17) either directly through the secondary pilot line 27A or indirectly through the shuttle valve 32 described below provided on the secondary pilot line 27B. Thus, the control valve 17 may be inputted a pilot pressure in accordance with the operation state of each driven element (hydraulic actuator) in the operation device 26. Accordingly, the control valve 17 can operate the respective hydraulic actuators in accordance with the operation state of the operation device 26 to implement the operation of the hydraulic actuators corresponding to the operation state of the operation device 26.

For example, the operation device 26 may be an electric type outputting an electrical signal corresponding to an operation state (hereinafter, referred to as "operation signal"). In this case, an operation signal from the operation device 26 is input to the controller 30, which may control corresponding control valves within the control valve 17 in response to the operation signal being input. This allows the controller 30 to implement the operation of the hydraulic actuator corresponding to the operation state of the operation device 26. For example, the controller 30 may control the hydraulic control valve ("operation hydraulic control valve") interposed with the pilot line connecting the pilot pump 15 and the control valve embedded in the control valve 17 that corresponds to the respective hydraulic actuator. This allows the controller 30 to apply a pilot pressure corresponding to the operation signal from the operation hydraulic control valve to each control valve in the control valve 17. For example, the control valves corresponding to the respective hydraulic actuators embedded in the control valve 17 may be solenoid spool valves driven by control commands corresponding to operation signals from the controller 30.

As described above, the shovel 100 may be remotely operated from a predetermined external device (for example, a management device 200 for managing the operation state of the shovel 100 or the like). In this case, the controller 30 may, for example, control the above-described hydraulic control valves in response to an operation command received from the external device to supply pilot pressure to the control valve 17 in accordance with the contents of the operation command. Accordingly, the control valve 17 can implement the operation of the shovel 100 according to the operation contents of the operator who performs the remote operation by the external device. Hereinafter, the "operator" may be used in a concept that comprehensively encompasses the operator who operates the shovel 100 remotely from the external device, as well as the operator who actually rises on the cabin 10 of the shovel 100, as described above.

The oil pressure control valve 31 is provided on a pilot line 25B which connects the pilot pump 15 to the shuttle valve 32. The oil pressure control valve 31 may adjust the pilot pressure output to the secondary side under the control of the controller 30. The oil pressure control valve 31 is, for example, a proportional valve configured to vary its flow area (the cross-sectional area through which hydraulic oil is allowed to flow). This allows the controller 30 to apply a predetermined pilot pressure from the oil pressure control valve 31 to the pilot port of the corresponding control valve in the control valve 17 even if the operation device 26 (individual operation device) connected to the shuttle valve 32 is not operated. Accordingly, the controller 30 may cause the hydraulic actuator corresponding to the control valve to which the oil pressure control valve 31 is connected to perform the desired operation regardless of the operator's operation. That is, the oil pressure control valve 31 is provided for each of the driven elements (hereinafter, for convenience, referred to as "universal driven elements") and the hydraulic actuators (hereinafter, for convenience, referred to as "universal actuated actuators") for which the controller 30 is able to operate universal without being operated by an operator.

The universal driven element includes, for example, at least the boom 4 and the bucket 6. Said differently, the universal actuator includes at least a boom cylinder 7 and a bucket cylinder 9. The universal driven element may also include, for example, the arm 5. Said differently, the universal actuator may include the arm cylinder 8.

When the operation device 26 is electric, the function of the oil pressure control valve 31 is replaced by the above-described hydraulic control valve. Both the operation of the hydraulic actuator according to the operation state of the operation device 26 and the operation of the hydraulic actuator independent of the operation state of the operation device 26 can be accomplished by a control command from the controller 30 to the control valve for operation.

The shuttle valve 32 is provided on the pilot line 27B on the secondary side of some individual operating devices included in the operation device 26. That is, the shuttle valve 32 is provided for a universal actuated element (the universal actuator) of a driven element (the hydraulic actuator) of which the operation device 26 is to be operated. The shuttle valve 32 has two inlet ports and one outlet port and causes the outlet port to output the hydraulic oil having a pilot pressure higher of the pilot pressure input to the two inlet ports. The shuttle valve 32 connects one from among the two inlet ports to the operation device 26 (individual operation device) and the other to the oil pressure control valve 31. An outlet port of the shuttle valve 32 is connected to a pilot port of a corresponding control valve in the control valve 17. This allows the shuttle valve 32 to apply the higher pilot pressure from among the pilot pressure generated by the operation device 26 (the individual operation device) and the pilot pressure generated by the oil pressure control valve 31 to the corresponding pilot port of the control valve. That is, the controller 30 controls the oil pressure control valve 31 and outputs a pilot pressure higher than the secondary pilot pressure output from the operation device 26 from the oil pressure control valve 31 such that the operation of the universal driven element (the universal actuator) can be controlled regardless of the operation of the operation device 26 by the operator.

All of the driven elements to be operated by the operation device 26 may be the universal driven elements. That is, all of the hydraulic actuators to be operated by the operation device 26 may be the universal actuators. In this case, all individual operating devices included in the operation device 26 are connected to the control valve 17 through the pilot line 27B and are provided with the oil pressure control valve 31 and the shuttle valve 32 for all the driven elements (hydraulic actuators) subject to operation of the operation device 26. Further, when the operation device 26 is electric, the shuttle valve 32 is omitted because the pilot pressure corresponding to the operation state is not output from the operation device 26. In addition, when the operation device 26 is electric, all of the driven elements (hydraulic actuators) of the operation device 26 may be universally driven elements (universal actuators) since the hydraulic control valves are provided for all of the driven elements, as described above.

<<Control System>>

As illustrated in FIG. 3, the control system of the shovel 100 in accordance with the present embodiment includes the operation pressure sensor 29, the controller 30, the display device 40, and the input device 42. The control system of the shovel 100 according to the present embodiment includes a boom angle sensor S1, an arm angle sensor S2, a bucket angle sensor S3, a body tilt sensor S4, a rotation state sensor S5, a positioning device S6, and a communication device T1.

As described above, the operation pressure sensor 29 detects the pilot pressure on the secondary side of the operation device 26, i.e., the pilot pressure corresponding to the operation state (e.g., an operation direction, an operation amount, etc.) of each driven element (hydraulic actuator) in the operation device 26. A pilot pressure detection signal corresponding to the operation state of the respective driven elements (hydraulic actuators) in the operation device 26 by the operation pressure sensor 29 is incorporated into the controller 30. Accordingly, the controller 30 can grasp the operation state (the operation contents) of the operation device 26.

In addition, in place of the operation pressure sensor 29, other sensors capable of detecting the operation state of each driven element in the operation device 26 may be provided, such as an encoder or potentiometer capable of detecting the operation amount (tilt amount) or tilt direction of a lever device. Also, when the operation device 26 is electric, the operation pressure sensor 29 can be omitted. An electrical signal (an operation signal) representing the operation state of the operation device 26 is input to the controller 30 from the operation device 26.

The controller 30 (an example of the control device) is provided, for example, within the cabin 10 to provide various controls with respect to the shovel 100.

The controller 30 may implement its functions in any hardware or any combination of hardware and software. For example, the controller 30 is configured to be disposed around a microcomputer including memory devices such as a CPU (Central Processing Unit), RAM (Random Access Memory), an auxiliary storage device such as a ROM (Read Only Memory), and interface devices for various inputs and outputs. The controller 30 includes an automatic control unit 301 and a rod relief control unit 303 as a functional unit implemented by executing, for example, a program installed in the auxiliary storage device on the CPU. The controller 30 utilizes a storage unit 302. The storage unit 302 may be implemented by the auxiliary storage device of the controller 30 or an external storage device communicatively connected with the controller 30.

Some of the functions of the controller 30 may be implemented by other controllers (control device). That is, the functions of controller 30 may be implemented in a manner that is distributed by a plurality of controllers. For example, the machine control function may be implemented by a dedicated controller (control device).

The display device 40 is provided in a location enabling the operator to easily watch the display device 40 while the operator is seated in the cabin 10 and displays various information images under a control of the controller 30.

For example, the display device 40 may display information about the construction state by the machine control function. Specifically, the display device 40 may display the information about flatness of the ground to be constructed. The controller 30 may calculate the movement trajectory of the claw tip or the back face of the bucket 6 by the MC function based on, for example, the output of the boom angle sensor S1, the arm angle sensor S2, and the bucket angle sensor S3, and obtain the flatness of the ground to be constructed based on the calculated movement trajectory.

The input device 42 is positioned within reach of the operator seated in the cabin 10 and receives various inputs from the operator and outputs signals corresponding to those inputs to the controller 30. The input device 42 includes, for example, a touch panel mounted to a display area (display unit) of the display device 40. The input device 42 may also include, for example, a knob switch provided at the tip end of a lever unit of the individual operation device included in the operation device 26. The input device 42 may also include button switches, levers, toggles, rotational dials, and the like, located around display device 40. The input device 42 may also include a sound input device or a gesture input device capable of receiving a sound input or gesture input of a user (operator). A signal corresponding to the operation contents for the input device 42 is incorporated into the controller 30.

The input device 42 includes a machine control switch ("MC switch") 42*a*.

The MC switch 42*a* is used to enable (i.e., turn ON) the machine control function of shovel 100. The MC switch 42*a* may be in a manner capable of switching the machine control function on/off (i.e., ON/OFF) each time it is operated, for example. The machine control switch 42*a* may be provided, for example, at the tip end of the lever unit of the individual operation device corresponding to the arm 5 (arm cylinder 8) and enabled to activate (turn on) the machine control function only while the operation (for example, pressed operation) is being performed.

The boom angle sensor S1 is mounted to the boom 4 and detects an attitude angle (hereinafter, referred to as "boom angle") of the boom 4. The boom angle sensor S1 may include, for example, a rotary encoder, an acceleration sensor, a 6-axis sensor, an IMU (Inertial Measurement Unit), or the like. The boom angle sensor S1 may also include a potentiometer using a variable resistor and a cylinder sensor for detecting the stroke amount of a hydraulic cylinder (boom cylinder 7) corresponding to the boom angle. The same applies to the arm angle sensor S2 and the bucket angle sensor S3. A detection signal corresponding to the boom angle by the boom angle sensor S1 is incorporated into the controller 30.

The arm angle sensor S2 is mounted to the arm 5 and detects the attitude angle (hereinafter, referred to as "arm angle") of the arm 5. Detection signals corresponding to the arm angle by the arm angle sensor S2 are incorporated into controller 30.

The bucket angle sensor S3 is mounted to the bucket 6 and detects an attitude angle (hereinafter, referred to as "bucket angle") of the bucket 6. The detection signal corresponding to the bucket angle by the bucket angle sensor S3 is incorporated into the controller 30.

The body tilt sensor S4 detects the tilt condition of the body (the lower travel body 1 or the upper swivel body 3) against a predetermined plane (for example, a horizontal plane). The body tilt sensor S4 is mounted on the upper swivel body 3 and detects the tilt angle (hereinafter, referred to as "forward and backward tilt angle" and "left and right tilt angle") about the twin axes of the upper swivel body 3 in the fore and aft direction and the left and right directions, for example. The body tilt sensor S4 may include a pivot state a rotary encoder, an acceleration sensor, a 6-axis sensor, an IMU, or the like, for example. A detection signal corresponding to the tilt angle (front and back tilt angles and right and left tilt angles) by the body tilt sensor S4 is incorporated into the controller 30.

The rotation state sensor S5 outputs detection information concerning the rotation state of the upper swivel body 3. The rotation state sensor S5 detects, for example, the rotation angle speed and the rotation angle of the upper swivel body 3. The rotation state sensor S5 may include a gyro sensor, a resolver, a rotary encoder, or the like. The detection signal corresponding to the rotation angle and the rotation angular velocity of the upper swivel body 3 by the rotation state sensor S5 is incorporated into the controller 30.

The positioning device S6 measures the position and direction of the upper swivel body 3. The positioning device S6 is a GNSS (Global Navigation Satellite System) compass that detects the position and direction of the upper swivel body 3, and the detection signal corresponding to the position and direction of the upper swivel body 3 is incorporated into the controller 30. Among the functions of the positioning device S6, the function of detecting the direction of the upper swivel body 3 may be replaced by the direction sensor mounted on the upper swivel body 3.

The information on the position and direction of the upper swivel body 3 may be acquired from the external device (for example, a device for measuring the position of various work machines including the shovel 100, landforms, and the like, at a work site through the communication device T1. In this case, the positioning device S6 may be omitted.

The communication device T1 communicates with an external device (for example, a management device for managing the operation state of the shovel 100) through a predetermined communication line including, for example, a mobile communication network having a base station as a terminal, a satellite communication network using a communication satellite, the Internet, or the like. The communication device T1 may, for example, communicate with an external device (for example, a terminal device used by a supervisor or an administrator of a work site) through a communication line based on a near range communication standard such as Bluetooth ("Bluetooth" is a registered trademark) or WiFi.

The automatic control unit 301 controls the MC function (the operation-assisted MC function) that automatically supports the manual operation of the shovel 100 by the operator when the MC function is enabled (that is, turned ON) in response to the operation of the MC switch 42*a*. Specifically, the automatic control unit 301 controls an attachment (that is, at least one from among the boom 4, the arm 5, and the bucket 6) such that a predetermined work part of the bucket 6 performs a predetermined construction operation in response to the operator's operation of the arm 5 (hereinafter, referred to as "arm operation").

The automatic control unit 301 may automatically operate at least one from among the boom 4, the arm 5, and the bucket 6 such that the claw tip of the bucket 6 (an example of the first part) coincide with the target construction surface (an example of the target surface) when an operator performs a manual operation and causes the shovel 100 to perform an excavation operation, for example. Therefore, the automatic control unit 301 can cause the excavation operation to be performed by the shovel 100 such that the claw tip of the bucket 6 moves along the target construction surface. The claw tip of the bucket 6 has a pointed shape and has a relatively small area in contact with the ground, making it suitable as a working site for the bucket 6 used in excavation operations of the shovel 100. Hereinafter, a control mode in which the claw tip of the bucket 6 performs a predetermined construction operation by the MC function is referred to as "bucket claw tip MC control," and a mode of movement of the shovel 100 in which the bucket claw tip MC control is performed is referred to as "bucket claw tip mode".

The automatic control unit 301 may automatically operate at least one from among the boom 4, the arm 5, and the bucket 6 such that the back face of the bucket 6 (an example of the second unit) moves along the ground, for example, when the operator performs a manual operation and causes the shovel 100 to perform a pressure transferring operation (a compaction operation). In this case, the automatic control unit 301 may control the attachment such that the back face of the bucket 6 functions a pressing force above a predetermined standard on the ground. Accordingly, the automatic control unit 301 can cause the shovel 100 to perform pressure transfer onto the ground (compacting the ground). The back face of the bucket 6 has a generally planar shape and a curved shape with a relatively slow curvature, and the area contacting the ground is relatively large. Therefore, the bucket 6 is suitable as a work site for use in the pressure transferring (compaction) operation of the shovel 100. "Substantially" is intended to permit manufacturing errors, etc., and the same applies below. Hereinafter, a control mode in which a predetermined construction operation is performed on the back face of the bucket 6 by the MC function is referred to as "bucket back face MC control", and an operation mode of the shovel 100 in which the bucket back face MC control is performed is referred to as "bucket back face MC mode". In the back face MC control of the bucket, the predetermined construction operation may be performed using a substantially flat part of the back face of the bucket 6, or a predetermined construction operation may be performed using a curved shape part of the back face of the bucket 6. In addition, when a curved part of the bucket 6 is used, the area contacting the ground is smaller than when a flat part of the bucket 6 contacts the ground is used, such that the pressure to compact the ground (transfer the pressure to be incorporated) can be relatively increased. When the flat part of the bucket 6 is used, relatively large areas can be compacted together because the area contacting the ground is larger than when the curved part is used. Therefore, the back face MC control of the bucket may be classified into a control corresponding to the flat part of the back face on the bucket 6 (hereinafter, referred to as "bucket back face MC first control") and a control corresponding to the curved part of the back face on the bucket 6 (hereinafter, referred to as "bucket back face MC second control"). Similarly, the bucket back face MC mode may be divided into a mode corresponding to a plane unit of the back face of the bucket 6 (hereinafter, referred to as "bucket back face MC first control") and an action mode corresponding to a curved part of the back face on the bucket 6 (hereinafter, referred to as "bucket back face MC second control").

The automatic control unit 301 acquires various information from a boom angle sensor S1, an arm angle sensor S2, a bucket angle sensor S3, a body tilt sensor S4, a rotation state sensor S5, a positioning device S6, a communication device T1, an operation pressure sensor 29, an input device 42, and a storage unit 302. The automatic control unit 301 generates a target trajectory (e.g., trajectory along the target construction surface) and a target position on the target trajectory of the working part of the bucket 6 based on the acquired information. The automatic control unit 301 may automatically control the operation of the attachment, for example, such that the working part of the bucket 6 moves to a target position on the target trajectory (i.e., moves along the target trajectory). Specifically, the automatic control unit 301 controls the operation of the oil pressure control valve 31 (or the hydraulic control valve for operation) corresponding to at least one from among the boom 4, the arm 5, and the bucket 6 to achieve the MC function.

The automatic control unit 301 may reflect the level of the ground to be acquired (measured) in the control of the MC function in the construction operation of the working part of the bucket 6 in the MC function. That is, the automatic control unit 301 may determine a construction operation (e.g., a target trajectory) in which the ground is flattened at the working part of the bucket 6 in accordance with the flatness of the acquired ground, and control the attachment. The automatic control unit 301 may adjust the pressing force against the ground on the back face of the bucket 6, for example, depending on the flatness of the acquired ground surface.

The information concerning the target construction surface (hereinafter, referred to as "target construction surface information") is stored in the storage unit 302. Target construction surface information may be input by an operator through the input device 42 and registered in the storage unit 302. The target construction surface information may be downloaded from a predetermined external device (for example, a provider's server device which manages a work site or a management terminal of a management office of a work site) through the communication device T1 and registered in the storage unit 302.

The rod relief control unit 303 outputs a control command to the relief valve 7RV and performs control of the relief valve 7RV (hereinafter, referred to as "rod relief control") such that the pressure value of the rod-side oil chamber of the boom cylinder 7 is restricted to below a predetermined threshold value.

<Control Process for Machine Control Function>

Figure 4:
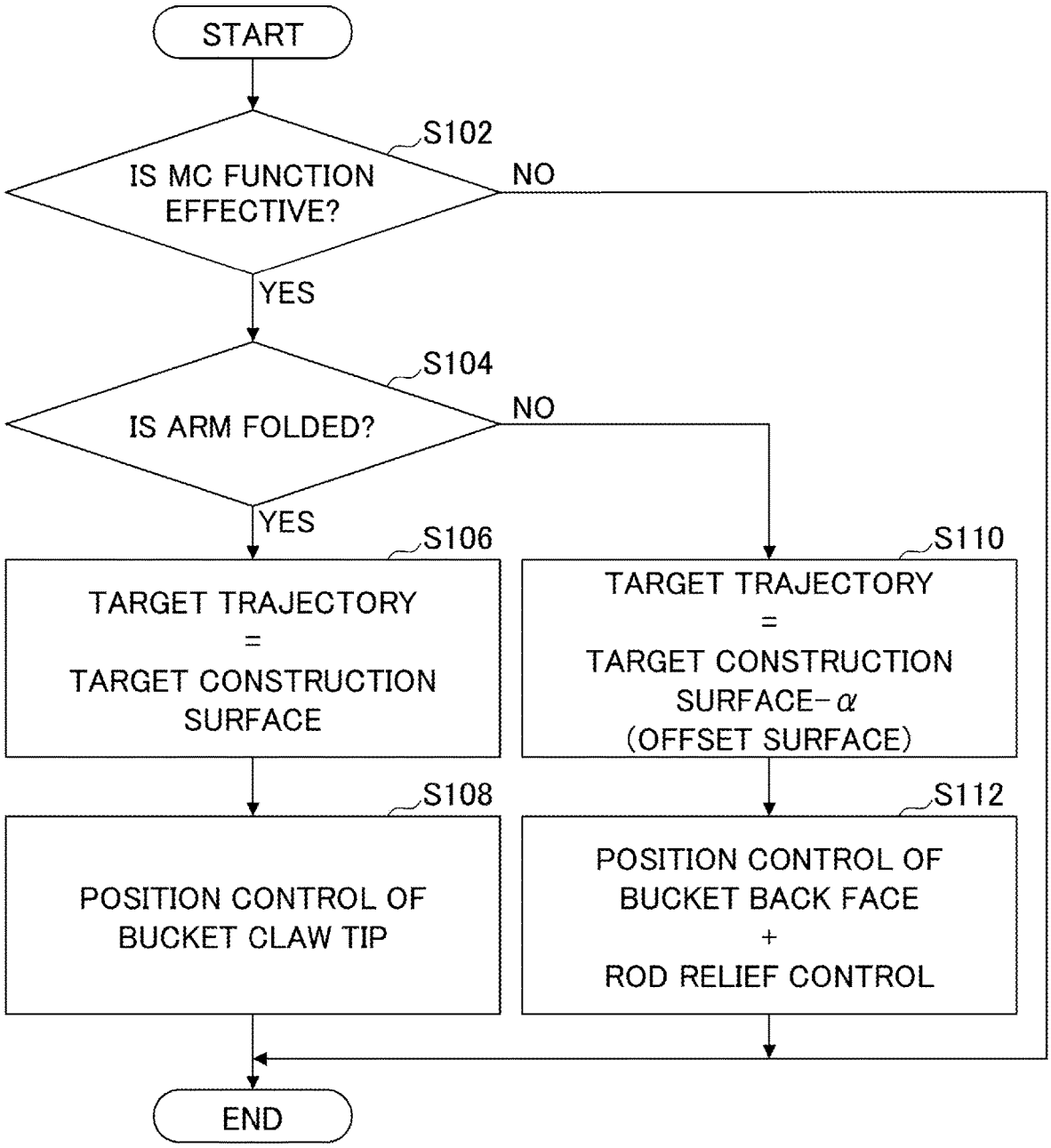
FIG. 4 is a flowchart schematically illustrating a first example of a control process related to a machine control function performed by a controller.

FIG. 4 is a flowchart schematically illustrating a first example of the control process regarding the MC function by the controller 30. During the operation of the arm 5 is performed from the start (key switch ON) to the stop (key switch OFF) of the shovel 100, the flow chart is repeatedly carried out at a predetermined processing cycle. The same shall apply to the flowchart of FIG. 7, which will be described later.

Figure 5A:
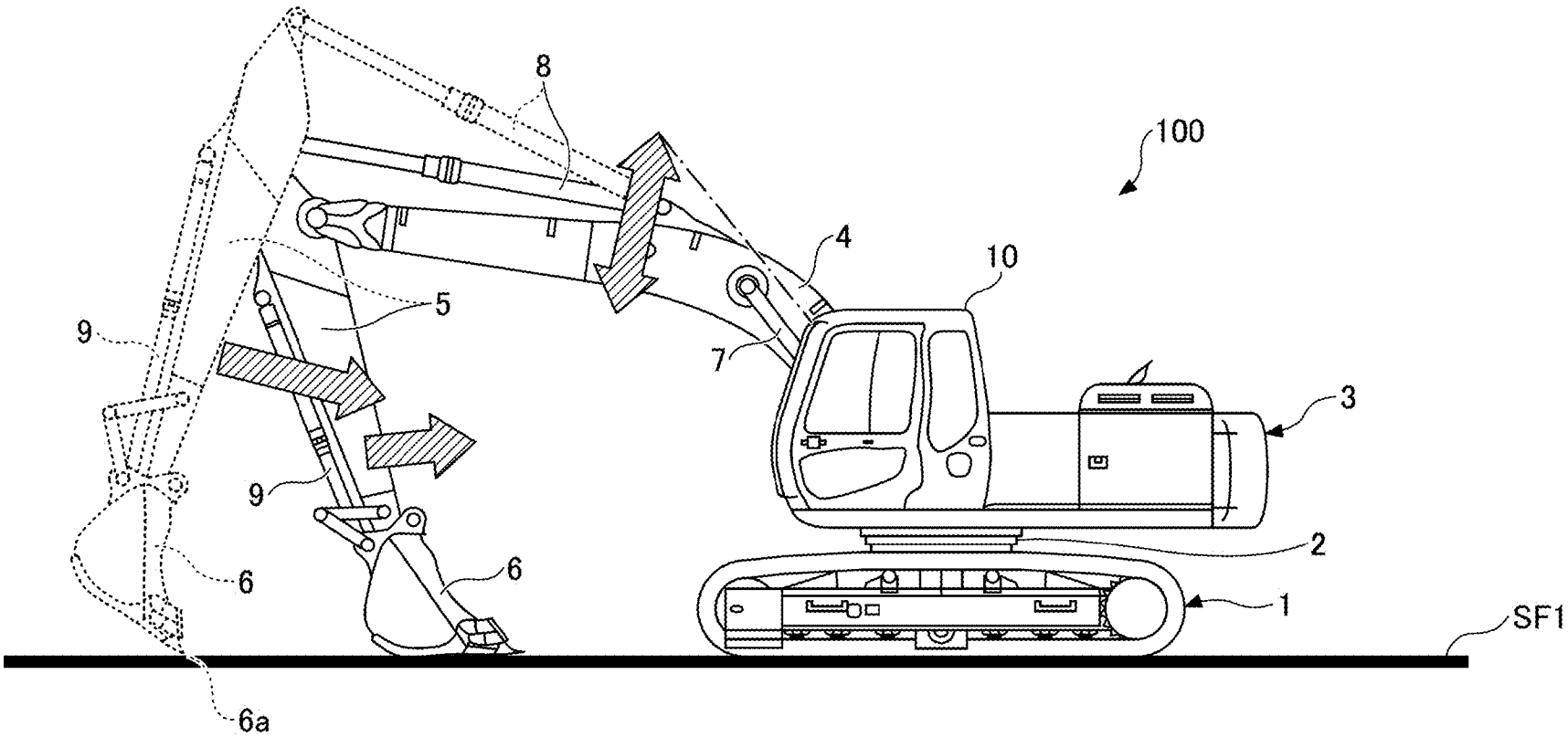
FIG. 5A is a diagram illustrating an operation of the shovel by the machine control function.
Figure 5B:
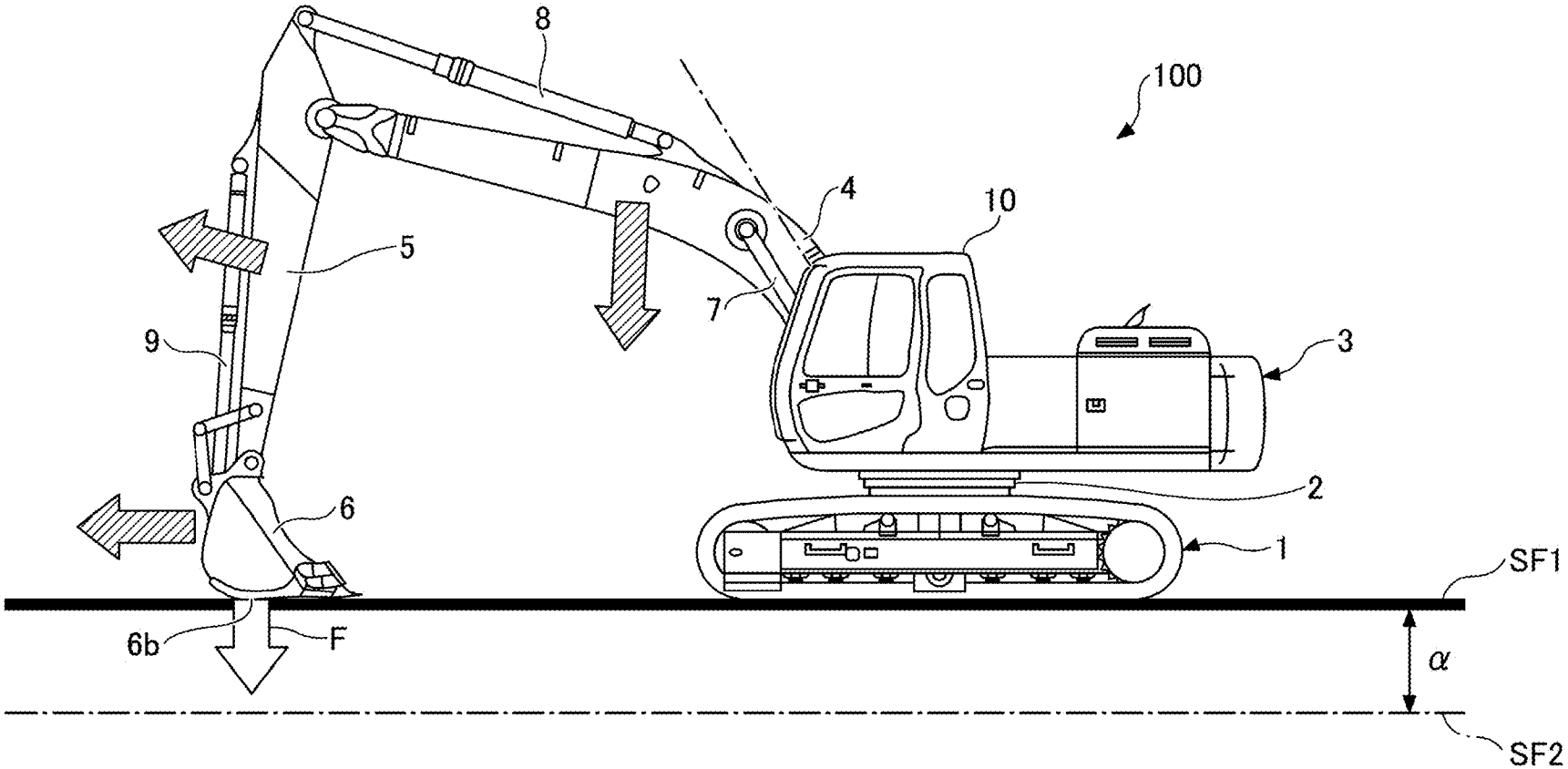
FIG. 5B is a diagram illustrating another operation of the shovel by the machine control function.

FIGS. 5A and 5B are diagrams illustrating an action of the shovel 100 by the MC function. Specifically, FIG. 5A illustrates an action performed by the MC function of the shovel 100 when an operation (hereinafter, referred to as "arm folding operation") of folding the arm 5 is performed. FIG. 5B illustrates an operation by the MC function of the shovel 100 when an operation (hereinafter, referred to as "arm stretching operation") of stretching the arm 5 is performed.

As illustrated in FIG. 4, in step S102, the controller 30 determines whether the MC function is valid. When the MC function is enabled, the controller 30 proceeds to step S104. When the MC function is not enabled, the controller 30 terminates the processing.

In step S104, the controller 30 determines whether the operation of folding the arm 5 (hereinafter, referred to as "arm folding operation") is performed. When the operation of folding the arm is performed, the controller 30 proceeds to step S106. When the arm folding operation is not performed, that is, when the operation of stretching the arm 5 (hereinafter, referred to as "arm stretching operation") is performed, the controller 30 proceeds to step S110.

In step S106, the automatic control unit 301 of the controller 30 sets the target trajectory of the working part of the bucket 6 in the MC function to a trajectory corresponding to the target construction surface. That is, the automatic control unit 301 sets the target trajectory such that the working part of the bucket 6 moves along the target construction surface in the MC function.

When the process of step S106 is completed, the controller 30 proceeds to step S108.

In step S108, the automatic control unit 301 of the controller 30 controls the attachment (at least one from among the boom 4, the arm 5, and the bucket 6) and controls the position of the claw tip of the bucket 6 such that the claw tip of the bucket 6 moves along the target trajectory (the target construction surface). Said differently, the automatic control unit 301 performs a bucket back face MC control.

When the processing in step S108 is completed, the controller 30 ends the present processing.

Accordingly, as illustrated in FIG. 5A, the shovel 100 moves the claw tip 6*a* (an example of the first part) of the bucket 6 along the target construction surface SF1 in accordance with the arm folding operation, and scrapes off a part that is above the target construction surface SF1 to make a flat ground surface.

Returning to FIG. 4, in step S110, the automatic control unit 301 of the controller 30 sets the target trajectory of the working part of the bucket 6 in the MC function to a trajectory corresponding to an offset surface in which the target construction surface is offset to the ground side by a predetermined amount $\alpha$, and proceeds to step S112. That is, the automatic control unit 301 sets the target trajectory such that the working part of the bucket 6 moves along the offset surface in the MC function.

When the process of step S110 is completed, the controller 30 proceeds to step S112.

In step S112, the automatic control unit 301 of the controller 30 controls the position of the back face of the bucket 6 such that the back face of the bucket 6 moves along a target trajectory (offset surface). That is, the automatic control unit 301 performs the bucket back face MC control. Specifically, the automatic control unit 301 of the controller 30 may control the position of the back face of the bucket 6 and the attitude of the bucket 6 such that a reference point of the back face of the bucket 6 coincides with the target trajectory (offset surface) and the back face of the bucket 6 becomes parallel to the target trajectory (offset surface). In addition, the rod relief control unit 303 of the controller 30 outputs a control command to the relief valve 7RV and performs the rod relief control.

When the process of step S112 is completed, the controller 30 completes the process of the present flowchart.

Accordingly, as illustrated in FIG. 5B, the shovel 100 can move the bucket 6 away from the body (upper swivel body 3) while pressing the back face 6*b* (an example of the second part) of the bucket 6 to the ground in accordance with the arm stretching operation. Specifically, because the controller 30 activates the attachment in order to match the back face of the bucket 6 to the offset surface SF2 below the ground, the back face of the bucket 6 can be pressed against the ground by a force (pressing force) F which causes the attachment to push the bucket 6 down. Therefore, the shovel 100 may scrape off the flat ground (target construction surface SF1) according to the arm folding operation and compact the ground (transfer pressure to the ground) according to the arm stretching operation. Thus, the operator can make the ground flat and compact the ground simply by repeating the arm folding operations and the arm stretching operations of the shovel 100, for example. In addition to the arm folding operation, the operator may alternately perform left-to-right rotation operations to compact the ground surface within a certain width on the forward side of the shovel 100 (for example, within the width of the lower travel body 1). In other words, the shovel 100 can improve the work efficiency of the ground leveling operation. At this time, the predetermined amount $\alpha$ may be a predetermined fixed value or a variable value. For example, a predetermined amount of $\alpha$ may be varied in accordance with the flatness of the subject ground as measured as described above, and may be set to be relatively large when the flatness is relatively not satisfactory and relatively small when the flatness is relatively satisfactory. Thus, the shovel 100 can adjust the pressing force against the ground by the back face of the bucket 6 in accordance with the flatness of the ground.

Further, because the rod relief control is performed in conjunction with the position control of the back face of the bucket 6, and the pressure of the rod-side oil chamber of the boom cylinder 7 is limited to be below the predetermined standard, the shovel 100 can limit the pressing force F against the ground on the back face of the bucket 6 to be below the predetermined standard. Therefore, the shovel 100 can prevent a situation in which the pressure of the rod-side oil chamber of the boom cylinder 7 is relatively increased and the pressing force against the ground by the back face of the bucket 6 is excessive.

For example, in the slope surface construction, it is preferable to keep the ground surface that supports the shovel 100 flat and firm in order to secure the construction quality and to ensure the safety of the shovel 100 during operation. In this case, the operator may simply repeat the arm folding operation and the arm stretching operation of the shovel 100 to create the flat and rigid stage for the shovel 100. Therefore, the shovel 100 can improve the work efficiency of the stage as a preliminary preparation for the slope construction.

In this example, the construction target ground (target construction surface) to be constructed is a horizontal surface, but it may be a slope (slope surface). In the present example, the controller 30 (the automatic control unit 301) may further use the bucket back face MC first control and a bucket back face MC second control. For example, the controller 30 may select whether the bucket back face MC control of the bucket in step S112 is the bucket back face MC first control or the bucket back face MC second control in accordance with the degree of irregularity (the degree of flatness) of the ground to be constructed, the geology, or the like. Specifically, the controller 30 may select the bucket back face MC first control when the flatness of the ground to be constructed is relatively large (high), and the bucket back face MC second control when the flatness of the ground to be constructed is relatively small (low). Further, the controller 30 may select the bucket back face MC first control when the geology of the ground to be constructed is relatively soft, and the bucket back face MC second control when the geology of the ground to be constructed is relatively hard. As described above, the ground flatness may be determined from the claw tip of the bucket 6 or the movement path of the back face by the MC function. The geology may also be determined, for example, based on the reaction from the ground to the bucket 6 during the movement of the bucket 6 by the MC function. The reaction force from the ground against the bucket 6 may be acquired (calculated) from the measured value of the cylinder pressure of the boom cylinder 7. The ground flatness and geology may also be determined from, for example, the imaged image of the imaging device 50.

[Second Example of Shovel]

Next, a second example of the shovel 100 according to the present embodiment will be specifically described with reference to FIGS. 1, 2, 5A, and 5B, and FIGS. 6 and 7. Hereinafter, a part different from the above-described first example will be mainly described, and the description of the same or corresponding contents of the above-described first example may be simplified or omitted.

<Structure of Shovel>

Figure 6:
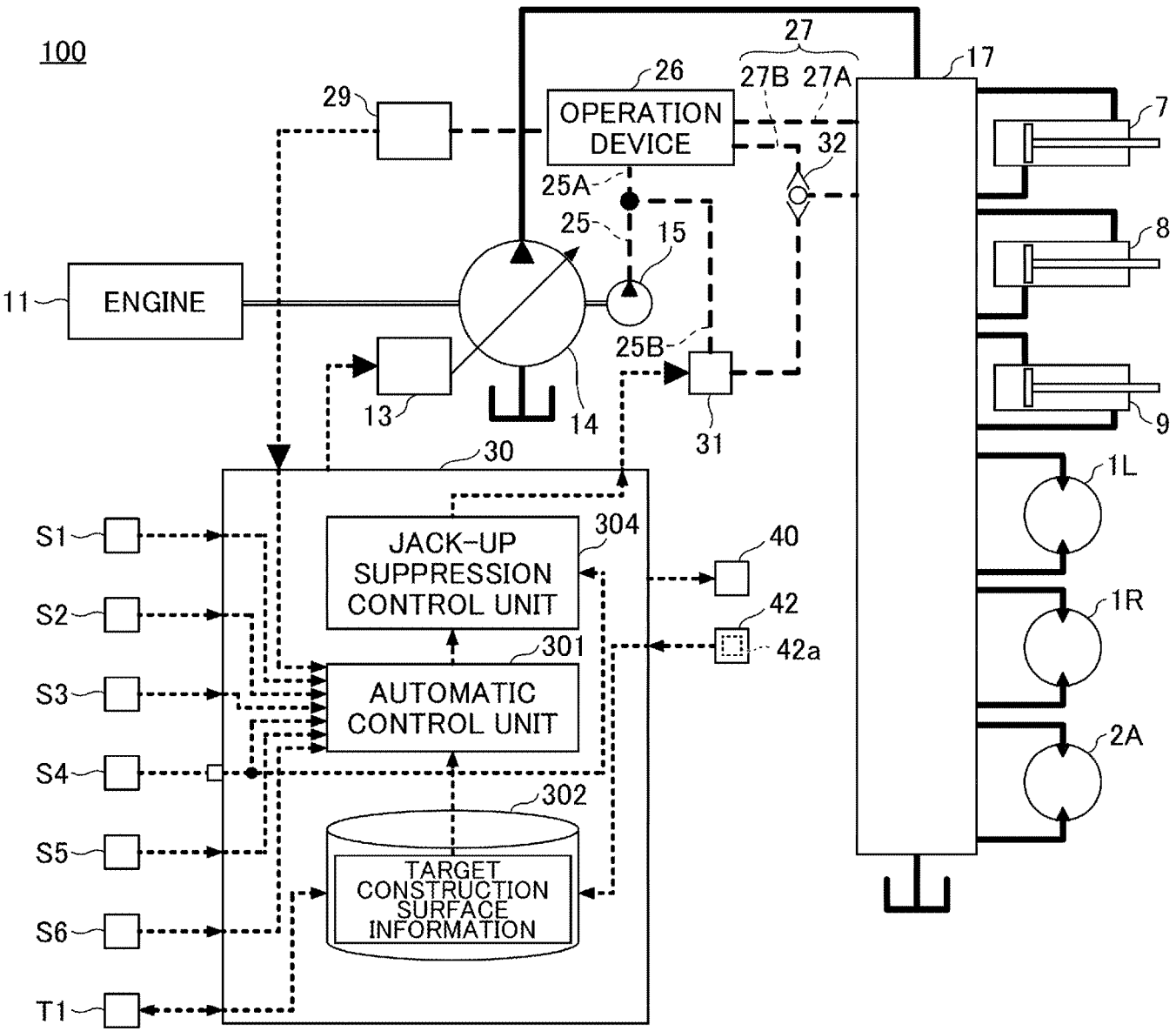
FIG. 6 is a block diagram schematically illustrating a second example of the structure of the shovel.

FIG. 6 is a block diagram schematically illustrating a second example of the structure of the shovel 100 according to the present embodiment.

As illustrated in FIG. 6, the shovel 100 according to the present example differs from the first example described above in that the relief valve 7RV is omitted and the jack-up suppression control unit 304 is included instead of the rod relief control unit 303 as a functional unit implemented by the controller 30.

The jack-up suppression control unit 304 controls the operation of the attachment (hereinafter, referred to as "jack-up suppression control") to suppress body uplift (hereinafter, referred to as "jack-up") in the shovel 100 (the lower travel body 1) due to the reaction force from the ground against the bucket 6.

The jack-up suppression control unit 304 determines whether the jack-up occurs in the shovel 100 based on, for example, the output of a body tilt sensor S4. The jack-up suppression control unit 304 may, for example, determines whether there is any sign (probability) that the jack-up occurs in the shovel 100 based on the output of the body tilt sensor S4. Then, the jack-up suppression control unit 304 controls the attachment so as to suppress the jack-up when it is determined that there is a jack-up occurring in the shovel 100 or there is a sign that the jack-up occurs. Specifically, the jack-up suppression control unit 304 may generate a control command for moving (returning) the boom 4 in the lifting direction and output the command to the oil pressure control valve 31 corresponding to the boom 4 (the boom cylinder 7). When the operation device 26 is an electric type, the jack-up suppression control unit 304 may output a similar control command to the operation hydraulic control valve corresponding to the boom 4 (boom cylinder 7).

When the MC function is enabled, the automatic control unit 301 generates a control command for the oil pressure control valve 31 or the control valve for operation to cause a work unit such as the claw tip or the back face of the bucket 6 to perform a predetermined operation. In this case, when it is determined that the jack-up is occurring in the shovel 100 or there is a sign that the jack-up occurs, the jack-up suppression control unit 304 corrects the control command output from the automatic control unit 301 so as to suppress the jack-up of the shovel 100. The jack-up suppression control unit 304 outputs the corrected control command to the hydraulic control valve or the control valve for operation. Specifically, the jack-up suppression control unit 304 may correct the control command corresponding to the boom 4 (the boom cylinder 7) out of the control command output from the automatic control unit 301.

<Control Processing for Machine Control Function>

Figure 7:
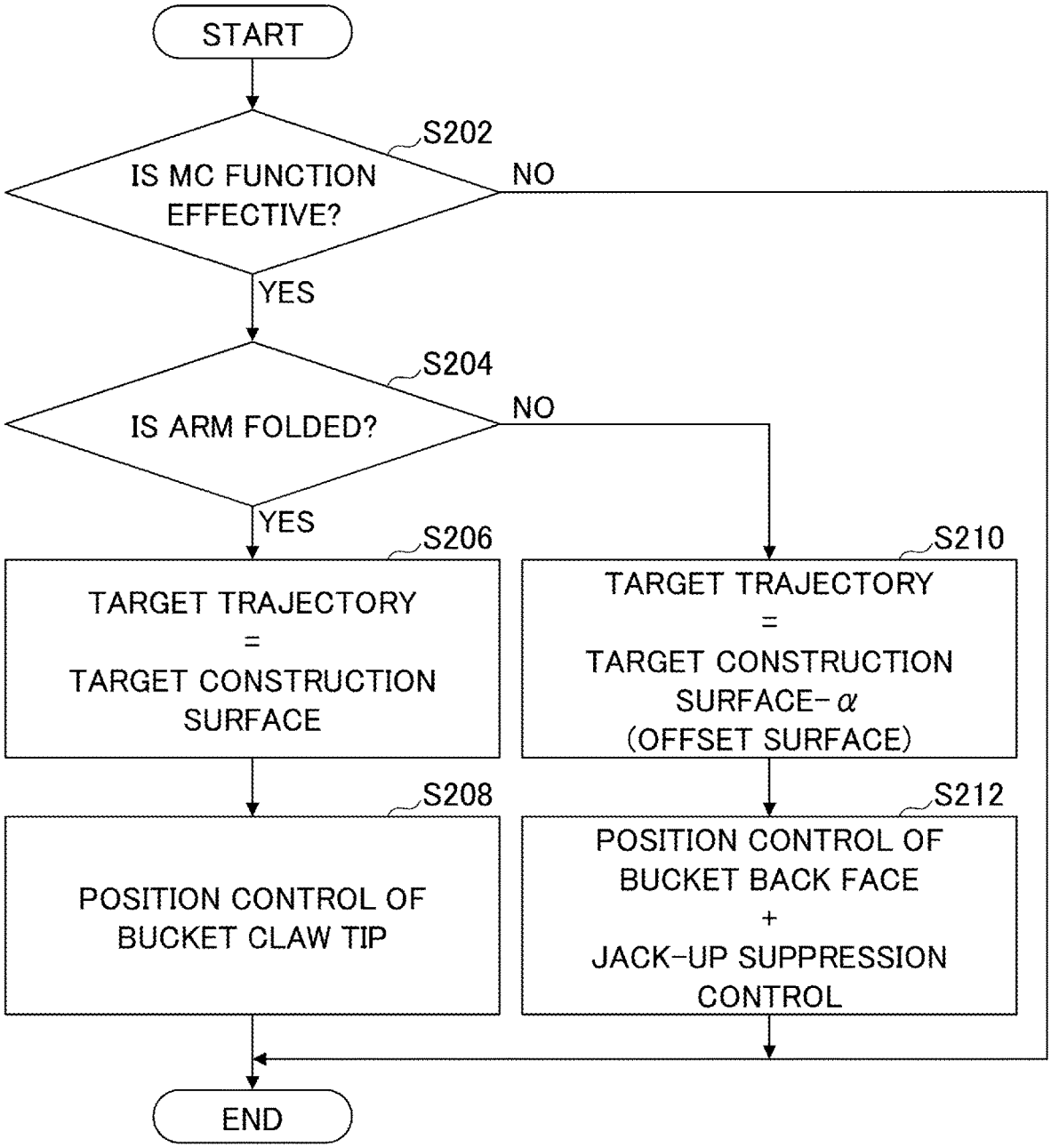
FIG. 7 is a flowchart schematically illustrating a second example of the control process related to the machine control function performed by the controller.

FIG. 7 is a flowchart schematically illustrating a second example of a control process regarding the MC function by the controller 30.

As illustrated in FIG. 7, the process of steps S202 to S210 is the same as those of steps S102 to S110 of FIG. 4, and thus the description thereof is not be repeated.

In step S212, the automatic control unit 301 of the controller 30 controls the position of the pawl tip of the bucket 6 such that the back face of the bucket 6 moves along a target trajectory (offset surface). In addition, the jack-up suppression control unit 304 of the controller 30 enables the jack-up suppression control.

Accordingly, the pressing force from the back face to the ground surface of the bucket 6 by the MC function is relatively increased, and when jack-up occurs or is likely to occur in the shovel 100, the operation of the attachment is controlled (corrected) so as to relax the pressing force. Therefore, the shovel 100 can limit the pressing force against the ground on the back face of the bucket 6 to a certain standard or less. Accordingly, the shovel 100 can prevent a situation in which the pressing force against the ground by the back face of the bucket 6 is excessive.

In the present example, the controller 30 (the automatic control unit 301) may use the bucket back face MC first control and the bucket back face MC second control as in the first example.

[Third Example of Shovel]

Next, a third example of a shovel 100 according to this embodiment will be specifically described with reference to FIGS. 8 to 10 in addition to FIGS. 1, 2, 5A, and 5B. Hereinafter, a part different from the above-described first example will be mainly described, and the description of the same or corresponding contents of the above-described first example may be simplified or omitted.

<Structure of Shovel>

The structure of the shovel 100 according to the present example may be the same as that of the first example (FIG. 3) or the second example (FIG. 6) described above. Therefore, in the present example, an illustration and an explanation of the structure thereof will be omitted.

<Control Processing for Machine Control Functions>

Figure 8:
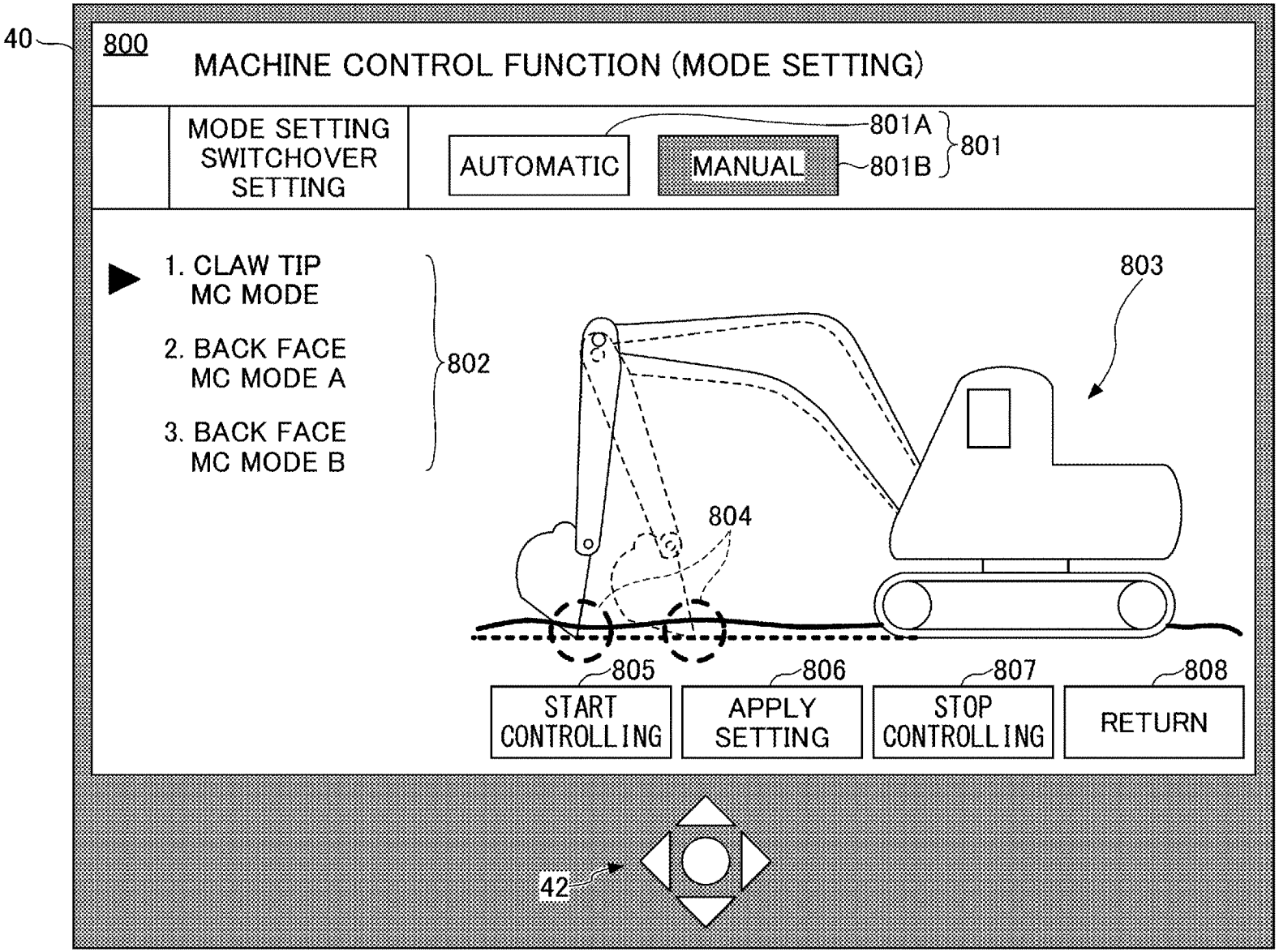
FIG. 8 is a diagram illustrating an example of a screen for setting an operation mode of the machine control function.
Figure 9:
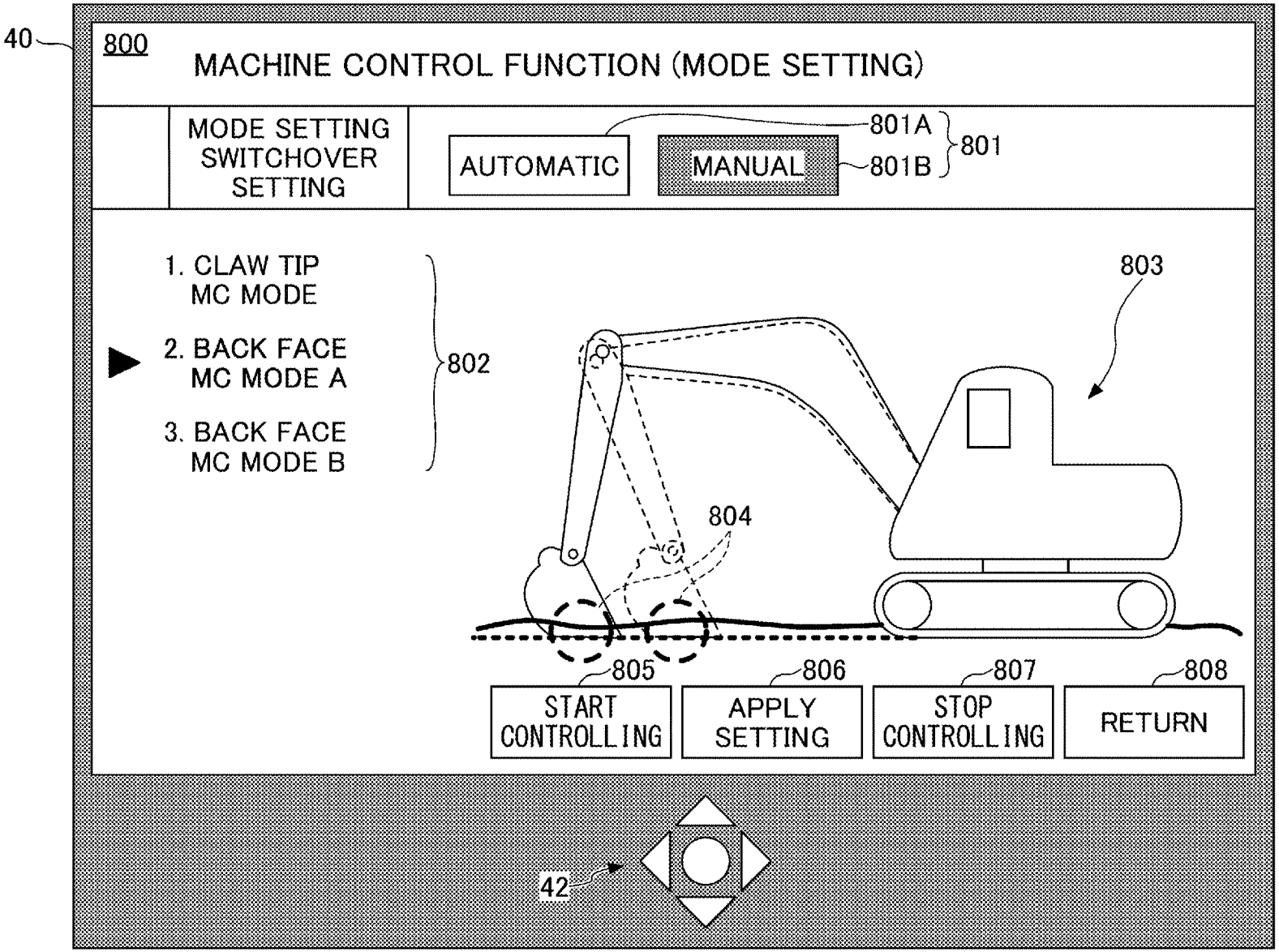
FIG. 9 is a diagram illustrating another example of the screen for setting the operation mode of the machine control function.
Figure 10:
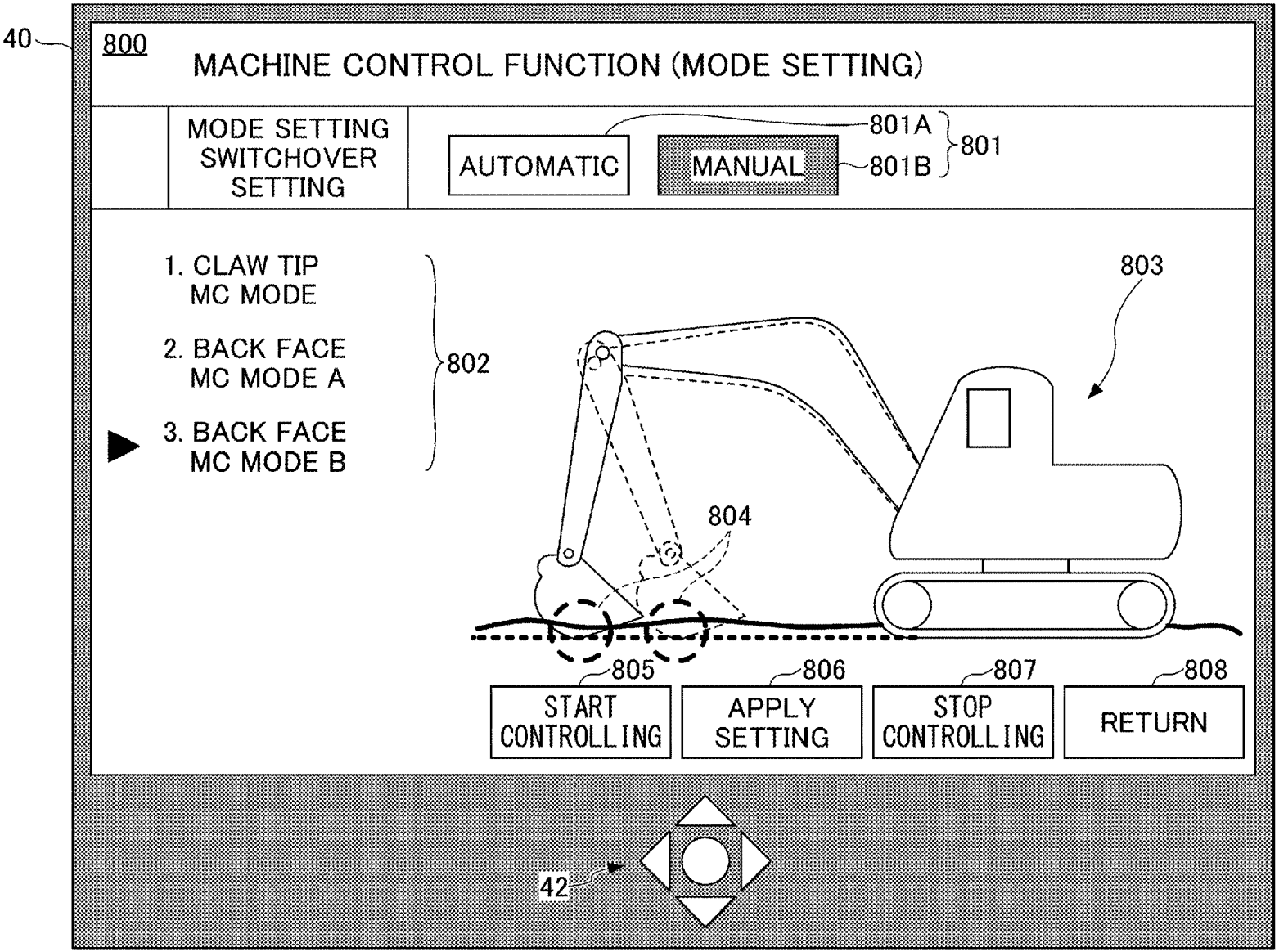
FIG. 10 is a diagram illustrating another example of the screen for setting the operation mode of the machine control function.

FIG. 8 to FIG. 10 are diagrams illustrating an example of a screen (a mode setting screen) for setting the operation mode of the MC function.

In this example, the controller 30 switches between the bucket claw tip MC mode and the bucket back face MC mode in response to predetermined inputs received from an operator (user) through the input device 42. The controller 30 may also switch to a mode among the bucket claw tip MC mode, the bucket back face MC first mode, and the bucket back face MC second mode, depending on the predetermined input received from the operator through the input device 42. This allows the operator to manually switch the mode of operation for the MC function between the bucket claw tip MC mode and the bucket back face MC mode, or between the bucket claw tip MC mode, the bucket back face MC first mode, and the bucket back face MC second mode.

Specifically, the controller 30 may display a screen (mode setting screen) for setting the operation mode of the MC function on the display device 40. This allows the operator to manipulate the mode setting screen using the input device 42 to set the mode of operation of the desired MC function.

For example, as illustrated in FIGS. 8-10, a mode setting screen 800 is displayed on the display device 40 under the control of the controller 30.

The mode setting screen 800 includes a button icon 801, a selected target mode list 802, a shovel image 803, a working part image 804, and button icons 805 to 808.

The button icon 801 is located at the top of the mode setting screen 800 and is used to select whether the MC function's multiple operating modes are switched automatically or manually by a predetermined input from an operator. The button icon 801 includes the button icons 801A and 801B.

The button icon 801A is used to set up the automatic switching of multiple action modes of the operation of the MC function. For example, when the button icon 801A is selected through the input device 42 and the button icon 805 or the button icon 806 described below is operated, a setting for automatically switching the plurality of operating modes of the MC function is established. In this case, the controller 30 automatically switches between the bucket claw tip MC mode and the bucket back face MC mode, or among the bucket claw tip MC first mode, the bucket back face MC second mode, and the bucket MC second mode (see FIGS. 4 and 7) in a situation where the MC function is enabled.

The button icon 801B is used to perform the setting of manually switching multiple modes of operation of the MC function. For example, when the button icon 801B is selected through the input device 42, the user (operator) moves the plurality of modes of operation of the MC function to a manually selectable screen state using the input device 42. Specifically, the mode setting screen 800 may shift to a state in which a selected target mode list 802 can be operated (for example, a state in which the gray out of the selected target mode list 802 is eliminated) through the input device 42 when the button icon 801B is selected.

The selection target mode list 802 is disposed to the right of the upper and lower center units of the mode setting screen 800 and represents the action mode of the MC function that can be selected by the user. In the selection target mode list 802, the action mode of the plurality of user selectable MC functions are displayed in the vertical direction. In this example, the bucket claw tip MC mode ("1. Nail claw tip MC mode"), the bucket back face MC first mode ("2. Back face MC mode A"), and the bucket back face MC second mode ("3. Back face MC mode B") are listed from top to bottom. The user can select the desired mode of operation from among the three MC function action modes by moving a cursor (black triangle of FIGS. 8-10) up and down using the input device 42.

As illustrated in FIG. 8, when the cursor is aligned to the top of the selected target mode list 802, the bucket claw tip MC mode is selected and highlighted to indicate that character information in "1. claw tip MC mode" is selected (e.g., displayed in bold). Also, as illustrated in FIG. 9, when the cursor is aligned in the middle of the selected target mode list 802, the first mode of MC on the back face of the bucket is selected and highlighted to indicate that character information of "2. Back MC mode A" is selected (for example, it is displayed in bold letters). As illustrated in FIG. 10, when the cursor is positioned at the bottom of the target mode list 802, the second mode of MC on the back face of the bucket is selected, and the character information of "3. back face MC mode B" is highlighted (for example, it is displayed in bold letters).

The shovel image 803 schematically represents the construction operation by the MC function of the shovel 100. Specifically, the working part of the bucket 6 is moved along the target construction surface (dashed line in FIGS. 8 to 10) using an image of the attachment outline with a solid line and an image of the attachment outline with a dashed line. Also, the image of the attachment indicated by the dashed line may be omitted, and the image indicated by the solid line may be replaced by a moving active image in which the working part of the bucket 6 moves along the target construction surface. The shovel image 803 (the image of the attachment indicated by the solid line attachment) may be operatively configured by the user using the input device 42 and moved such that the working part of the bucket 6 moves along the target construction surface in accordance with the user's operation. Accordingly, the user (operator) can visually understand an operation of the shovel 100 by the MC function.

Specifically, as illustrated in FIG. 8, the shovel image 803 shows that the claw tip of the bucket 6 moves along the target construction surface when the bucket claw tip MC mode is selected. Further, as illustrated in FIG. 9, the shovel image 803 illustrates that, when the bucket back face MC first mode is selected, a unit having a substantially flat shape on the back face of the bucket 6 moves along the target construction surface. Further, as illustrated in FIG. 10, the shovel image 803 illustrates that, when the second mode of the MC back face of the bucket is selected, a unit of the curved surface shape of the back face of the bucket 6 moves along the target construction surface. This allows the user (operator) to visually (easily) understand which working part of the bucket 6 is used to perform the work by the MC function of the shovel 100 for each selected mode of operation.

In the working part image 804, the working part of the shovel image 803 corresponding to the working part of the bucket 6 is stressed. In this example, the working part image 804 is represented by a circular frame of a broken line displayed on the part of the shovel image 803 corresponding to the working part of the bucket 6. The working part image 804 may be represented by a circular frame of a solid line that blinks instead of the circular frame of the broken line. Specifically, as illustrated in FIG. 8, the working part image 804 stresses a part of the shovel image 803 corresponding to the claw tip of the bucket 6 abutting on the ground (target construction surface) when the bucket claw tip MC mode is selected. As illustrated in FIG. 9, the working part image 804 stresses a part of the shovel image 803 corresponding to the substantially planar unit of the back face of the bucket 6 abutting on the ground (target construction surface) when the first mode of the MC is selected. As illustrated in FIG. 10, the working part image 804 stresses the part of the shovel image 803 corresponding to a curved surface unit of the back face of the bucket 6 abutting on the ground (target construction surface) when the bucket MC back face second mode is selected. This allows the user (operator) to more easily understand which working part of the bucket 6 is used to perform the work by the MC function of the shovel 100 for each selected action mode of operation.

The button icon 805 is used to determine the content set in the mode setting screen 800 and to initiate control for the MC function. Accordingly, by performing an operation of selecting and confirming the button icon 805 using the input device 42, the user can transfer the state of the shovel 100 to a state where the MC function is enabled according to the setting content of the mode setting screen 800. That is, the button icon 805 is the operation unit corresponding to the function to enabled the MC function of the shovel 100 among the functions of the MC switch 42*a*.

The button icon 806 is used to apply the contents set in the mode setting screen 800 to the control of the MC function. Accordingly, the user can determine the setting contents of the mode setting screen 800 while the MC function is enabled by performing an operation of selecting and determining the button icon 806 using the input device 42.

A button icon 807 is used to stop control of the MC function by the controller 30. Thus, the user can switch the shovel 100 to an invalid state of the MC function by performing an operation of selecting and confirming the button icon 807 using the input device 42. Said differently, the button icon 807 is an operation unit corresponding to the function to disable the MC function of the shovel 100 among the functions of the MC switch 42*a*.

The button icon 808 is used to return the display contents of the display device 40 from the mode setting screen 800 to a predetermined screen (for example, a home screen) at a higher level. Thus, for example, when the user (operator) thinks that it is not necessary to set the action mode of the MC function due to a change in his/her mind, the display contents of the display device 40 can be switched from the mode setting screen 800 to the home screen or the like without performing the setting.

Thus, in this embodiment, the user may manually switch multiple modes of operation of the MC function using the input device 42.

In this example, the user may use the input device 42 to select whether to automatically switch or manually switch multiple modes of operation of the MC function.

In this example, a function for automatically switching a plurality of operation modes of the MC function (see FIGS. 4 and 7) may be omitted. In this case, the button icon 801 of FIGS. 8-10 is omitted.

In the present embodiment, the user may operate the mode setting screen 800 with the input device 42 to select a desired mode of the operation from among a plurality of modes of operation of the MC function. In addition, the user can check a selection state of a plurality of operation modes of the MC function through the mode setting screen.

In the present embodiment, a plurality of action modes of the MC function may be selected through a simple input unit (for example, a selection dial) included in the input device 42 instead of the mode setting screen. In this case, the display device 40 may only display a screen for checking the selection state of multiple modes of operation of the MC function, the construction operation, the working part, or the like for each of the multiple action modes in the same manner as the mode setting screen 800.

[Function]

Next, the function of the shovel 100 according to the present embodiment will be described. In this embodiment, the shovel 100 includes an attachment including a boom, an arm, and a bucket. The bucket 6 also includes the claw tip and the back face. The claw tip and the back face mutually differ in their shapes. The shovel 100 has a bucket claw tip MC mode for activating the attachment such that the claw tip of the bucket 6 moves along a predetermined trajectory in response to the operation of the attachment, and a bucket back face MC mode for operating the attachment such that the back face of the bucket 6 moves along a predetermined trajectory in response to the operation of the attachment.

This allows the user to use the MC function for each of the construction operations of the shovel 100 using the working parts of the bucket 6, which are different in their shapes. Therefore, it is possible to avoid a situation such that the construction operation using one working part of the bucket 6 can be performed on the shovel 100 using the MC function, and the construction operation using another working part of the bucket 6 is manually performed without using the MC function. Accordingly, the shovel 100 can improve work efficiency of the shovel 100 using of the MC function can be improved.

In this embodiment, the back face of the bucket 6 may also include a planar-shaped part and a curved-shaped part. The shovel 100 may, as the bucket back face MC mode, operate the attachment in response to the operation of the attachment such that the planar-shaped part of the back face on the bucket 6 moves along the predetermined trajectory, or operate the attachment such that the curved-shaped part of the back face on the bucket 6 moves along the predetermined trajectory in response to the operation of the attachment.

This allows the user to use a part in which the contact area with the ground on the back face of the bucket 6 is relatively large and a part in which the contact area with the ground is narrow in the construction operation of the shovel 100 using the back face of the bucket 6. Therefore, the shovel 100 can further improve the work efficiency due to the MC function.

In this embodiment, the shovel 100 may activate the attachment such that a predetermined working part of the bucket 6 (e.g., the claw tip of the bucket 6 or the back face of the bucket 6) performs a predetermined construction operation in response to the operation of the attachment. Specifically, the shovel 100 may activate the attachment such that the working part of the bucket 6 moves along a predetermined trajectory (target trajectory) in response to the operation of the attachment. The shovel 100 may be switched between the bucket claw tip MC mode and the bucket back face MC mode based on the operation state (the operation state of the attachment) of the shovel 100. That is, the controller 30 may control the attachment such that the predetermined working part of the bucket 6 performs the predetermined work operation in response to the operation of the attachment. The controller 30 may automatically switch between the bucket claw tip MC control for controlling the attachment such that the claw tip of the bucket 6 performs the predetermined construction operation in response to the operation of the attachment and the bucket back face MC control for controlling the attachment such that the back face of the bucket 6 performs the predetermined operation in response to the operation of the attachment based on the operation state of the shovel 100 (the operation state of the attachment).

This eliminates the need for the operator to manually switch between the bucket claw tip MC control and the bucket back face MC control. Therefore, the shovel 100 can suppress an interruption of the work when, for example, the bucket claw tip MC control and the bucket back face MC control are switched. Therefore, the shovel 100 can improve the work efficiency in the MC function.

The controller 30 may automatically switch between the bucket claw tip MC control and the bucket back face MC control instead of or in addition to the operating condition of the shovel 100, depending on the situation of the circumference of the shovel 100. For example, the controller 30 may measure the flatness of the ground to be constructed, employ the bucket claw tip MC control when the flatness is relatively low, and cause the shovel 100 to perform the construction operation in which the ground is scraped off with the claw tip of the bucket 6. On the other hand, when the flatness is relatively high, the controller 30 may employ the bucket back face MC control to cause the shovel 100 to perform a construction operation in a manner to compact and make the flattened ground to a certain degree tight. The controller 30 may also automatically switch between the bucket claw tip MC control and the bucket back face MC control depending on the operating condition of the shovel 100 and at least one from among the conditions around the shovel 100, or in addition, depending on the load condition from the ground acting on the (working area) bucket 6. For example, the controller 30 estimates a load (frictional resistance) acting from the ground on the bucket 6, and when the estimated load is relatively large, the bucket claw tip MC control may be employed to cause the shovel 100 to perform the construction operation in which the ground is scraped off with the claw tip of the bucket 6. On the other hand, when the estimated load is relatively small, the controller 30 may employ the bucket back face MC control to cause the shovel 100 to perform the construction operation in the manner of compacting the ground surface on the back face of the bucket 6. At this time, the controller 30 may estimate a load (frictional resistance) functioning from the ground on the working part of the bucket 6 based on the moving direction (the lifting direction or the lowering direction) of the attachment (boom 4) and the pressure in the oil chamber of the boom cylinder 7.

In this embodiment, the shovel 100 may operate the attachment such that the claw tip of the bucket 6 moves along the target construction surface in accordance with the operation of the attachment in the claw tip mode. Meanwhile, the shovel 100 may activate the attachment in the bucket back face MC control such that the back face of the bucket 6 presses against the ground in response to the operation of the attachment (specifically, the back face of the bucket 6 moves along the ground while being pressed against the ground). That is, the controller 30 may control the attachment such that the claw tip of the bucket 6 moves along the target construction surface in response to the operation of the attachment in the bucket claw tip MC control. On the other hand, the controller 30 may control the attachment such that the back face of the bucket 6 presses against the ground in response to the operation of the attachment in the bucket back face MC control.

Accordingly, the shovel 100 can automatically switch, in the MC function, between the construction operation in which the ground is scraped off with the claw tip of the bucket 6 and brought closer to the target construction surface and the construction operation in which the ground is pressed against the back face of the bucket 6 and compacted.

In this embodiment, the shovel 100 may activate the attachment such that the bucket back face moves along an offset surface in which a predetermined amount of the target construction surface is offset to the ground side in response to the operation of the attachment in the bucket back face MC mode. That is, the controller 30 may control the attachment such that the back face of the bucket 6 moves along the offset surface in which a predetermined amount of the target construction surface is offset to the ground side in accordance with the operation of the attachment in the bucket back face MC control.

Accordingly, the shovel 100 can apply the force to press the back face of the bucket 6 against the ground from the back face of the bucket 6 by activating the attachment in an attempt to move the back face of the bucket 6 to an offset surface below the ground. Therefore, the shovel 100 can perform the concrete compaction (pressure transfer) of the ground by the bucket back face MC control of the bucket.

In this embodiment, in the bucket back face MC control, the shovel 100 may activate the attachment such that the back face of the bucket 6 moves along the offset surface in response to the operation of the attachment and the pressing force against the ground is equal to or less than a predetermined standard value. That is, the controller 30 may control the attachment such that the back face of the bucket 6 moves along the offset surface in response to the operation of the attachment and the pressing force against the ground is equal to or less than the predetermined standard value in the bucket back face MC control.

Therefore, while the shovel 100 performs the compaction of the ground surface by the pressing force from the back face of the bucket 6, it is possible to prevent the situation in which the pressing force acting on the ground surface from the back face of the bucket 6 becomes excessive.

In this embodiment, in the bucket back face MC control, the controller 30 may correct the control command regarding the attachment for moving the back face of the bucket 6 along the offset surface so as to suppress the body uplift due to the reaction force from the ground, and control the attachment using the corrected control command.

Thus, the shovel 100 can specifically suppress the situation in which the pressing force acting on the ground from the back face of the bucket 6 becomes excessive.

In this embodiment, the controller 30 may control the attachment such that the back face of the bucket 6 moves along the offset surface in accordance with the operation of the attachment in the bucket back face MC control, and control the relief valve 7RV such that the pressure of the rod-side oil chamber of the boom cylinder 7 is equal to or less than a predetermined threshold value.

With this, the shovel 100 can specifically prevent a situation in which the pressing force acting on the ground from the back face of the bucket 6 becomes excessive.

In this embodiment, the controller 30 may automatically switch between the bucket claw tip MC control and the bucket control depending on the operation of the attachment. For example, the controller 30 may perform the bucket claw tip MC control when the folding operation of the arm 5 is performed and also may perform the bucket back face MC control when the stretching operation of the arm 5 is performed.

Thus, for example, the shovel 100 can implement a series of construction operations in which the ground is scraped off with the claw tip of the bucket 6 such that the ground matches the target construction surface in accordance with the folding operation of the arm 5, and the ground is compacted on the back face of the bucket 6 in accordance with the stretching operation of the arm 5.

In this embodiment, the shovel 100 may switch between the MC function action mode (bucket claw tip MC mode and bucket back face MC mode) in response to a predetermined input received from the user (operator) through the input device 42.

Accordingly, the user can manually switch the action mode of the MC function according to, for example, the contents and arrangements of a series of operations performed by the shovel 100.

In this embodiment, the display device 40 may display a screen for checking the selection state of any one of the MC function action modes (the bucket claw tip MC mode and the bucket back face MC mode) and a screen for selecting any of the MC function action modes (the bucket claw tip MC mode and the bucket back face MC mode).

Therefore, the user can easily check the selected action mode among the MC function action modes or easily select a desired action mode of operation from among the mode of operation of the MC function to be selected through the screen of the display device 40.

In this embodiment, the shape of the bucket 6 may be displayed in a manner that allows different work parts (claw tip and back face associated with each of the AC action modes of the MC function as the selection target (bucket claw tip MC and mode bucket back face MC mode).

Accordingly, the user can intuitively grasp the working part of the bucket 6 used in the MC function action mode and the contents of the corresponding work the MC function action mode through the screen of the display device 40. Accordingly, the user can intuitively grasp, through the screen of the display device 40, the working part of the bucket 6 used in the action mode of the selected MC function and the corresponding work contents. The user may also intuitively select a desired action mode among the action modes of the MC function to be selected through the screen of display device 40.

In this embodiment, the shovel 100 (controller 30) may measure the ground flatness based on the movement trajectory of the working part of the bucket 6 and reflect the measured flatness in the working part of the bucket 6 in the MC function.

This allows the shovel 100 to optimize the construction operation of the working part of the bucket 6 during construction operations where the MC function flattens the ground according to the conditions of the flatness of the ground to be constructed. Therefore, the shovel 100 can improve the work efficiency of the work to flatten the ground to be constructed.

[Modification/Change]

While the embodiments of the invention have been described in detail above, the invention is not limited to such specific embodiments, and various modifications and variations are possible within the scope of the invention as defined in the appended claims.

For example, in the above-described embodiment, the MC function in which the entire attachment automatically performs the predetermined action in response to the operation of the arm 5 as the operation of the attachment is performed. However, a similar MC function may be implemented in the operation of the boom 4 or the bucket 6 instead of an operation of the arm 5.

Also, for example, in the above-described embodiments, variations, or modifications thereof, all driven elements are hydraulically driven. However, some or all of the plurality of driven elements may be electrically driven. Said differently, the shovel 100 may be a hybrid shovel or an electrical shovel. For example, the upper swivel body 3 may be electrically driven by an electric motor instead of the swivel hydraulic motor 2A.

In accordance with the embodiments described above, a technique can be provided such that the work efficiency of the shovel using the machine control function is improved.

DESCRIPTION OF SYMBOLS

1: Lower travel body
1L, 1R: Travel hydraulic motor
2: Swivel mechanism
2A: Swivel hydraulic motor
3: Upper swivel body

4: Boom
5: Arm
6: Bucket
7: Boom cylinder
7RV: Relief valve
8: Arm cylinder
9: Bucket cylinder
26: Operation device
30: Controller (controller)
31: Oil pressure control valve
32: Shuttle valve
40: Display device
42: Input device
42*a*: Machine control switch
50: Imaging device
100: Shovel
200: Management device
301: Automatic control unit
302: Storage unit
303: Rod relief control unit
304: Jack-up suppression control unit
S1: Boom angle sensor
S2: Arm angle sensor
S3: Bucket angle sensor
S4: Body tilt sensor
S5: Rotation state sensor
S6: Positioning device
T1: Communication device

What is claimed is:

1. A shovel comprising:

an attachment including a boom; an arm; and a bucket;

an upper swivel body, to which the boom is mounted; and a control device configured to control an action of the attachment;

wherein the bucket includes a first part and a second part, wherein the first part comprises a claw tip, and the second part comprises a back face;

wherein the control device is configured to:

determine whether a current movement of the attachment corresponds to an arm folding movement by determining whether the bucket is moving towards the upper swivel body; and execute an automatic control process by:

when the current movement is determined to correspond to the arm folding movement, automatically controlling at least one component selected from a group consisting of the boom, the arm, and the bucket to perform a first action; and when the current movement is determined not to correspond to the arm folding movement, automatically controlling at least one component selected from the group to perform a second action, wherein the first action causes the first part to move along a first predetermined trajectory, and the second action causes the second part to move along a second predetermined trajectory.

2. The shovel according to claim 1, wherein an area where the first part contacts ground is smaller than an area where the second part contacts the ground.

3. The shovel according to claim 2, wherein the second part includes a planar-shaped part and a curved-shaped part, and wherein, in response to an operation of either the boom, the arm, or the bucket, the attachment performs the second action causing the planar-shaped part to move along the second predetermined trajectory or the curved-shaped part to move along the second predetermined trajectory.

4. The shovel according to claim 2, wherein, in response to an operation of either the boom, the arm, or the bucket, the attachment performs the first action causing the claw tip of the bucket to move along a target plane, and the second action causing the back face of the bucket to move while the back face is pressing against the ground.

5. The shovel according to claim 4, wherein, in response to the operation of either the boom, the arm, or the bucket, the attachment performs the second action causing the back face to move along an offset surface that is obtained by shifting by a predetermined amount from the target plane to a ground side while maintaining a parallel relationship between the back face and a ground face.

6. The shovel according to claim 5, wherein, in response to the operation of either the boom, the arm, or the bucket, the attachment performs the second action causing the back face to move along the offset surface such that a pressing force against the ground is equal to or less than a predetermined reference value.

7. The shovel according to claim 6, wherein, in the second action, the control device corrects a control command for the attachment of moving the back face along the offset surface to restrict body uplift due to reaction force from the ground, and controls the attachment using the corrected control command.

8. The shovel according to claim 6, wherein a relief valve configured to relieve hydraulic oil in a rod-side oil chamber of a boom cylinder that drives the boom to a hydraulic oil tank, wherein, in the second action, the control device controls the attachment such that the back face moves along the offset surface in response to the operation of either the boom, the arm, or the bucket and controls the relief valve such that the rod-side oil chamber has a pressure not greater than a predetermined threshold value.

9. The shovel according to claim 1, wherein the shovel is configured to switch between performing the first action and the second action depending on a content of the operation of either the boom, the arm, or the bucket.

10. The shovel according to claim 9, wherein the first action is performed in a case where an arm folding operation is performed, and the second action is performed in a case where an arm stretching operation is performed.

11. The shovel according to claim 1, wherein the shovel is configured to switch between performing the first action and the second action depending on a predetermined input received by an operator.

12. The shovel according to claim 11, further comprising:

a display device configured to display a screen for checking a state of selecting any one action between the first action and the second action and/or another screen for selecting the any one action between the first action and the second action.

13. The shovel according to claim 12, wherein the screens display shapes of the bucket in a manner such that the first part and the second part respectively associated with the first action and the second action are viewable.

14. The shovel according to claim 1, wherein flatness of a ground is measured based on a movement trajectory of the attachment and the flatness is applied to the first action and the second action.

15. The shovel according to claim 1, wherein the shovel is configured to switch between performing the first action and the second action based on either an operation state of an actuator that drives the attachment, a flatness of a ground around the shovel, or both.

16. The shovel according to claim 15, wherein the flatness is determined from a movement path of either the first part, the second part, or both.

* * * * *